United States Patent [19]

Deguchi et al.

[11] Patent Number: 4,994,358

[45] Date of Patent: Feb. 19, 1991

[54] DIRECT POSITIVE COLOR LIGHT-SENSITIVE MATERIAL

[75] Inventors: Naoyasu Deguchi; Shigeo Hirano, both of Kanagawa, Japan

[73] Assignee: Fuji Photo Film Co., Ltd., Kanagawa, Japan

[21] Appl. No.: 232,825

[22] Filed: Aug. 15, 1988

[30] Foreign Application Priority Data

Aug. 14, 1987 [JP] Japan ..... 62-201936

[51] Int. Cl.[5] ..... G03C 1/485; G03C 1/46; G03C 7/18

[52] U.S. Cl. ..... 430/547; 430/378; 430/504; 430/505; 430/571; 430/598; 430/955

[58] Field of Search ..... 430/547, 598, 406.411, 430/410, 571, 378, 504, 505, 955, 957

[56] References Cited

U.S. PATENT DOCUMENTS

| | | | |
|---|---|---|---|
| 3,846,128 | 11/1974 | Thomas et al. | 96/3 |
| 4,358,528 | 11/1982 | Takagi et al. | 430/598 |
| 4,390,618 | 6/1983 | Kobayashi et al. | 430/543 |
| 4,656,123 | 4/1987 | Mihayashi et al. | 430/598 |

*Primary Examiner*—Paul R. Michl

*Assistant Examiner*—Thorl Chea

*Attorney, Agent, or Firm*—Sughrue, Mion, Zinn, Macpeak & Seas

[57] ABSTRACT

A direct positive color light-sensitive material is disclosed, which comprises a support having thereon at least one internal latent image-forming silver halide emulsion layer containing non-prefogged silver halide grains and which contains at least one color image-forming coupler capable of producing or releasing a non-diffusible or diffusible dye upon oxidative coupling with a color developing agent, with at least one layer different from the internal latent image-forming silver halide emulsion layer containing a surface latent image-forming, negative-working silver halide emulsion and with at least one of the negative-working silver halide emulsion layer and an interlayer adjacent thereto containing at least one compound capable of releasing a fogging agent, a fogging agent precursor, a development promoter or a development promoter precursor in proportion to the amount of developed silver of the negative-working silver halide emulsion upon development processing using an aromatic primary amine developing agent.

19 Claims, No Drawings

DIRECT POSITIVE COLOR LIGHT-SENSITIVE MATERIAL

FIELD OF THE INVENTION

This invention relates to a direct positive color light-sensitive material which provides a direct positive color image when imagewise exposed and subjected to color development processing after or simultaneously with fogging processing.

BACKGROUND OF THE INVENTION

Photographic processes for obtaining a direct positive image without reversal processing or without the use of a negative-working film have been well known.

Conventionally known processes of forming positive images using direct positive silver halide photographic light-sensitive materials can be classified into two main types from the standpoint of practical usefulness, excluding special types.

One type of such processes employs a previously fogged silver halide emulsion, in which fogging nuclei (latent image) in exposed areas are destroyed by solarization or the Hershel effect to obtain a positive image after development processing.

Another type uses an internal latent image-forming silver halide emulsion not having previously been fogged, in which, after imagewise exposure, surface development is conducted after or simultaneously with fogging processing to obtain direct positive images.

The above-described internal latent image-forming silver halide photographic emulsion is a silver halide photographic emulsion of the type which contains light-sensitive nuclei mainly within the interior of silver halide grains and forms a latent image mainly within the interior of grains upon being exposed to light.

The latter processes generally give a higher sensitivity than the former processes and are therefore suited for uses requiring high sensitivity. The present invention relates to a process of the latter type, using a non-prefogged internal latent image-forming silver halide emulsion.

In this technical field, various techniques are known, as described in, for example, U.S. Pat. Nos. 2,592,250, 2,466,957, 2,497,875, 2,588,982, 3,317,322 2,497,875, 3,761,266, 3,761,276, and 3,796,577 and British Pat. Nos. 1,151,363, 1,150,553, and 1,011,062.

Photographic direct positive light-sensitive materials having comparatively high sensitivity can be prepared by employing these known techniques.

Detailed descriptions of the mechanism by which direct positive images are formed are described in, for example, T. H. James; *The Theory of the Photographic* Process, (4th ed.), chap. 7, pp. 182–193 and U.S. Pat. No. 3,761,276.

That is, it is believed that fogging nuclei are selectively formed only on the surface of those silver halide grains in unexposed areas by surface-desensitizing action due to an internal latent image formed by the first imagewise exposure within the interior of silver halide grains, and that a photographic image (direct positive image) is formed in unexposed areas by subsequent ordinary "surface development processing".

As is described above, two processes are generally known for selectively producing fogging nuclei: one being a process of giving a second exposure all over the light-sensitive layer, which is referred to as a "light-fogging process" (described in, for example, British Patent 1,151,363); and the other being a process of using a nucleating agent, which is called a "chemically fogging process". The latter process is described in, for example, *Research Disclosure*, vol. 151, No. 15162 (Nov., 1976), pp. 72–87.

Formation of direct positive color images may be attained by subjecting an internal latent image-forming silver halide light-sensitive material to surface color development processing after or simultaneously with fogging processing, then bleaching and fixing processings or bleach-fixing processing, after which the material is usually washed with water and/or subjected to stabilization processing.

Many conventional processes have been disclosed for enhancing the interlayer effect in surface latent image-forming, negative-working color photographic light-sensitive materials to thereby improve color reproducibility.

The interlayer effect is described in, for example, Hanson; *Journal of the Optical Society of America*, Vol. 42, pp. 663–669, and A. Thiels; *Zeitschrift fur Wissenschaftliche Photographie, Photophysicue und Photo-chemie*, Vol. 47, pp. 106–118 and 248–255.

One process for enhancing the interlayer effect is a process of using DIR couplers capable of reacting with an oxidation product of a developing agent to release a development inhibitor. The DIR couplers are couplers having at the coupling-active site thereof a group which is to be released to form a development inhibitor or a precursor of such a group. Specific examples are described in, for example, U.S. Pat. Nos. 3,227,554, 3,701,783, 3,615,506, and 3,617,291.

U.S. Pat. No. 3,536,486 describes the introduction of a diffusible 4-thiazoline-2-thione into an exposed color reversal photographic element, and U.S. Pat. No. 3,536,487 describes the introduction of diffusible 4-thiazoline-2-thione into an unexposed color reversal photographic element, to obtain an interlayer effect.

JP-B-48-34169 (The term "JP-B" as used herein means an "examined Japanese Patent application") discloses that a remarkable interlayer effect is obtained by allowing an N-substituted-4-thiazoline-2-thione compound to be present upon development of color photographic materials whereby silver halide is reduced to silver.

In addition, (*Research Disclosure*, No. 13116 (Mar., b 1975) describes providing a colloidal silver-containing layer between a cyan layer and a magenta layer of a color reversal photographic element for obtaining an interlayer effect.

Further, U.S. Pat. No. 4,082,553 describes a technique for obtaining an interlayer effect by incorporating latent image-forming silver haloiodide grains in one layer of a color reversal photographic material having a layer structure which permits iodide ions to migrate therethrough during development, and incorporating in another layer latent image-forming silver halide grains and silver halide grains having been surface-fogged so as to be developed regardless of imagewise exposure.

However in direct positive light-sensitive materials, the above-described process using DIR couplers has the serious defect that color development is extremely delayed, and the other processes described above fail to provide satisfactory interlayer effect.

SUMMARY OF THE INVENTION

An object of the present invention is to enhance the interlayer effect in direct positive light-sensitive materials without delaying color development.

Another object of the present invention is to improve color reproducibility by enhancing the interlayer effect in the case of obtaining a direct positive image using an internal latent image-forming emulsion.

These and other objects of the present invention will become apparent from the following description thereof.

It has now been discovered that the above-described and other objects of the present invention are attained by a direct positive color light-sensitive material which comprises a support having thereon at least one internal latent image-forming silver halide emulsion layer containing non-prefogged silver halide grains and which contains at least one color image-forming coupler capable of producing or releasing a non-diffusible or diffusible dye upon oxidative coupling with a color developing agent, with at least one layer different from the internal latent image-forming silver halide emulsion layer containing a surface latent image-forming, negative-working silver halide emulsion and with at least one of the negative-working silver halide emulsion layer and an interlayer adjacent thereto containing at least one compound capable of releasing a fogging agent, a fogging agent precursor, a development promoter or a development promoter precursor in proportion to the amount of developed silver of the negative-working silver halide emulsion upon development processing using an aromatic primary amine developing agent.

DETAILED DESCRIPTION OF THE INVENTION

A method of reverse-imagewise inhibiting development of an internal latent image-forming emulsion layer by incorporating a DIR compound into a negative-working emulsion layer is described in U.S. Pat. No. 3,846,128. In the present invention, when the negative-working silver halide emulsion is developed, FA's or FR compounds are imagewise released. The FA's or FR compounds released diffuse to the internal latent image-forming emulsion layer and reverse-imagewise promote development of the internal latent image-forming emulsion layer.

The negative-working silver halide emulsion and the internal latent image-forming silver halide emulsion, the development of which is promoted reverse-imagewise by the negative-working silver halide emulsion, are desirably spectrally sensitized to substantially different spectral regions.

For example, in the case of providing a red-sensitive negative-working emulsion layer, it is preferably provided in such a position that it can reverse imagewise promote development of an internal latent image-forming emulsion layer having sensitivity to other than red light, for example, to green and/or blue light.

Further, another internal latent image-forming emulsion layer spectrally sensitized to the same spectral region as the negative-working silver halide emulsion layer is preferably provided separately in the light-sensitive material.

Two or more negative-working silver halide emulsion layers may be provided in the light-sensitive material.

The negative-working silver halide emulsion layer may contain diffusion-resistant reducing agents capable of capturing an oxidation product of a developing agent, for example, dihydroxybenzene derivatives described in U.S. Pat. Nos. 2,336,327, 2,360,290, 2,403,721, 3,700,453, and 2,701,197 and JP-A-46-2128, JP-A-54-29637, JP-A-53-9528 (The term "JP-A" as used herein means an "unexamined published Japanese patent application"), 2,5-disulfon-amidophenols described in *Research Disclosure*, No. 18143 or N-alkyl- or N-aryl-benzoisoxazolones described in *ibid.*, No. 18144. In addition, it is desirable to provide a light-insensitive layer containing a hydrophilic polymer (for example, gelatin) 0.05 to 5 μm, preferably 0.1 to 3 μm, in dry thickness between the negative-working silver halide emulsion layer and the internal latent image-forming silver halide emulsion layer. This light-insensitive layer may contain the above-described reducing agents.

The negative-working silver halide emulsion layer is desirably positioned nearer to the support than the internal latent image-forming silver halide emulsion layer nearest the support, and/or positioned farther from the support than the internal latent image-forming silver halide emulsion layer farthest from the support.

Heretofore, compounds capable of releasing a fogging agent, a fogging agent precursor, a development promoter or a development promoter precursor (hereinafter referred to as "FR compounds") have been practically used mainly in color photographic films for photographic use in order to obtain color photographic pictures having high maximum image density and good gradation. It has also been proposed to use them in photographic papers for color prints (color papers) (see, for example, U.S. Patent 4,390,618). However, these relate to negative emulsions which form a latent image mainly on the surface of silver halide grains, and nothing has been taught as to the solution of technical problems specific to internal latent image-forming, direct positive emulsions which form a latent image mainly within the interior of silver halide grains (for example, improvement of interlayer effect) by combining negative-working emulsions with the FR compounds.

Fogging agent's, fogging agent precursors, development promoters or development promoter precursors hereinafter refers to "FA". Fogging agents or development promoters include, for example, reductive compounds (e.g., hydrazine, hydrazide, hydrazone, hydroquinone, catechol, p-aminophenol, p-phenylenediamine, 1-phenyl-3-pyrazolidinone, enamine, aldehyde, polyamine, acetylene, aminoborane, quaternary salts such as tetrazolium salts and ethylenebispyridinium salts, and carbazinic acid) and compounds capable of forming silver sulfide upon development (e.g., thiourea and compounds of the structure

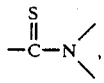

such as thioamide, dithiocarbamate, rhodanine, thiohydantoin or thiazolidinethione).

The FR compounds to be used in the present invention include the following:

(i) couplers capable of releasing FA or a precursor thereof upon coupling with an oxidation product of an aromatic primary amine developing agent;

(ii) couplers capable of producing, upon coupling with an oxidation product of an aromatic primary amine developing agent, a diffusible coupling product which functions as FA or a precursor thereof; and (iii) redox compounds capable of releasing FA or a precursor thereof by an oxidation-reduction reaction with an oxidation product of an aromatic primary amine developing agent or by a reaction subsequent to the oxidation-reduction reaction.

The above-described compounds (i), (ii) and (iii) are represented by formulae (1), (2), and (3), respectively.

$$C_p\text{-}(TIME)_n\text{-}FA \quad (1)$$

$$BALL\text{-}C_p\text{-}(TIME)_n\text{-}FA \quad (2)$$

$$RED\text{-}(TIME)_n\text{-}FA \quad (3)$$

In the above formulae, $C_p$ represents a coupler residue capable of coupling with an oxidation product of an aromatic primary amine developing agent to release $TIME_n$—FA in formula (1) and to release BALL in formula (2), BALL represents a diffusion-resistant group capable of being eliminated from $C_p$ by a coupling reaction with an oxidation product of an aromatic primary amine developing agent, and RED represents a compound residue capable of undergoing oxidation-reduction reaction with an oxidation product of an aromatic primary amine developing agent to release $TIME_n$—FA.

TIME represents a timing group capable of releasing FA after being released from $C_p$ or RED by the coupling reaction.

n is 0 or 1, and, when n represents 0, FA is a group capable of being eliminated from $C_p$ or RED by the coupling reaction and, when n represents 1, a group capable of being eliminated from TIME. (In compounds represented by formula (2), FA may not be released from Cor TIME after the coupling reaction. In this case, TIME does not function as a timing group.)

In formulae (1) to (3), FA represents a fogging agent which acts on silver halide grains upon development to produce fogging nuclei capable of initiating development, a fogging agent precursor, a development promoter or a development promoter precursor. The group FA includes, for example, those groups which, upon development, can exert an reductive action on silver halide grains to produce fogging nuclei or can act on silver halide grains to produce silver sulfide nuclei, i.e., fogging nuclei capable of initiating development.

The fogging agent precursor and the development promoter precursor are a TIME-containing fogging agent and a TIME-containing development promoter, respectively.

As FA, those groups capable of adsorbing to silver halide grains are preferred. Such groups may be represented by formula (4):

$$AD\text{-}(L)_m\text{—}X \quad (4)$$

wherein AD represents a group capable of adsorbing to silver halide grains; L represents a divalent linking group; m is 0 or 1; and X represents a reductive group or a group capable of acting on silver halide to produce silver sulfide provided that, when X represents the latter group, X in some cases has also the function of AD, thus AD—$(L)_m$— not being always necessary in such cases.

where FA is a group represented by AD—$(L)_m$—X, it may be bonded to TIME, $C_p$ or RED in any positiOn of AD—$(L)_m$—X.

In formula (1), —$(TIME)_n$—FA is bonded to the coupling site of $C_p$, and the bond is cleaved upon coupling reaction.

In the formula (2), BALL is bonded to the coupling site of $C_p$, and the bond is cleaved upon coupling reaction. Since —$(TIME)_n$—FA is bonded to a non-coupling site of $C_p$, the bond is not immediately cleaved upon coupling.

In formula (3), —$(TIME)_n$—FA is bonded to RED in a position from which it is released upon oxidation-reduction reaction with an oxidation product of an aromatic primary amine developing agent or upon a subsequent reaction.

The group represented by TIME in formula (1) may be a trivalent group. That is, one of the trivalent bonds is bonded to FA, and one of the remaining two is bonded to the coupling site of $C_p$ and the other to a non-coupling site of $C_p$. In compounds of such a structure, upon a coupling reaction with an aromatic primary amine developing agent, the bond to TIME in the coupling site is cleaved while the bond to TIME in the non-coupling site is not cleaved, and the cleaved bond (anion) of TIME in turn undergoes intramolecular electron migration and/or intramolecular nucleophilic substitution to cleave the bond between TIME and FA and release FA. Therefore, the trivalent TIME in such compounds is required to have a structure which permits the release FA by intramolecular electron migration and/or intramolecular nucleophilic substitution.

Formulae (1), (2) and (3) are described in more detail below.

In formula (1), the coupler residue represented by $C_p$ can be a colorless compound forming coupler or black color-forming coupler as well as that of the following yellow, magenta or cyan coupler.

Of these couplers, yellow couplers include those described in, for example, U.S. Pat. Nos. 2,875,057, 2,407,210, 3,265,506, 2,298,443, 3,048,194 and 3,447,928. Of those yellow couplers, acylacetamide derivatives such as benzoylacetanilide and pivaloylacetanilide are preferred.

Preferred yellow coupler residues ($C_p$) include those represented by formulae (Ia) and (IIa):

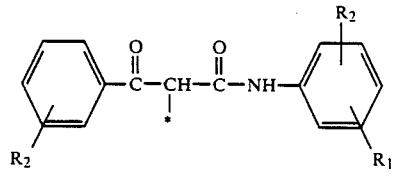

(Ia)

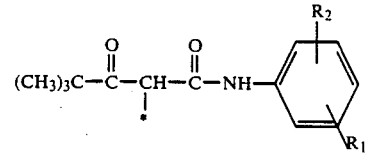

(IIa)

wherein * indicates the coupling position to which —$(TIME)_n$—FA is bonded in formula (1) and the coupling position to which -BALL is linked in formula (2) (hereinafter referred to as the "coupling position"); $R_1$ represents a diffusion-resistant group containing a total of 8 to 32 carbon atoms; $R_2$ represents at least one hydrogen, halogen, lower alkyl group, lower alkoxy group or diffusion-resistant group containing a total of 8 to 32 carbon atoms, provided that plural $R_2$ groups may be the same or different.

Typical examples of the magenta coupler are described in, for example, U.S. Pat. Nos. 2,600,788, 2,369,489, 2,343,703, 2,311,082, 3,152,896, 3,519,429, 3,062,653, 2,908,573, JP-B-47-27411, JP-A-59-171956, JP-A59-162548, JP-A-60-33552, JP-A-60-43659 and JP-A-172982. Of those magenta couplers, pyrazolones or pyrazoloazoles (for example, pyrazolopyrazole, pyrazoloimidazole, pyrazolotriazole, and pyrazolotetrazole) are preferred.

Preferred magenta coupler residues ($C_p$) include those represented by formulae (IIIa), (IVa) and (Va):

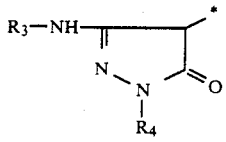
(IIIa)

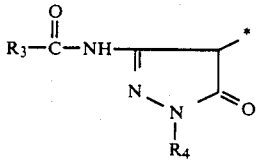
(IVa)

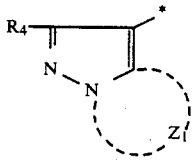
(Va)

wherein * indicates the coupling position; R3 represents a diffusion-resistant group containing a total of 8 to 32 carbon atoms; $R_4$ represents at least one halogen, lower alkyl group, lower alkoxy group, unsubstituted phenyl group or substituted phenyl group; and $Z_1$ represents a non-metallic atomic group necessary for forming a substituted or unsubstituted 5-membered azole ring containing 2 to 4 nitrogen atoms, or a condensed ring thereof.

Typical examples of cyan couplers are described in, for example, U.S. Patents 2,772,162, 2,895,826, 3,002,836, 3,034,892, 2,474,293, 2,423,730, 2,367,531, and 3,041,236, JP-A-56-99341, JP-A-57-155538, JP-A-57-204545, JP-A-58-189154, JP-A 59-31953, JP-A-58-118643, JP-A-58-7928, and JP-A-58-213748, and U.S. Pat. No. 4,333,999. Of these cyan couplers, phenolic couplers or naphtholic couplers are preferred.

Preferred cyan coupler residues ($C_p$) are represented by formulae (VIa), (VIIa), (VIIIa) and (IXa):

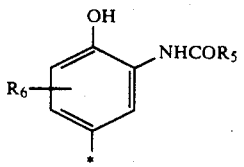
(VIa)

-continued

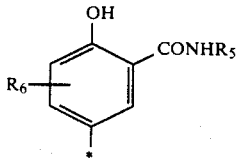
(VIIa)

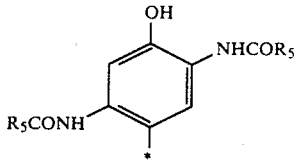
(VIIIa)

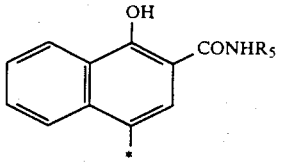
(IXa)

wherein * indicates the coupling position; $R_5$ represents a diffusion-resistant group containing a total of 8 to 32 carbon atoms, and $R_6$ represents at least one halogen, lower alkyl group or lower alkoxy group, provided that plural $R_6$ groups may be the same or different.

$C_p$ may be a colorless compound forming coupler.

Typical examples of the colorless compound forming couplers are described in, for example, U.S. Pat.. Nos. 3,912,513 and 4,204,867 and JP-A-52-152721.

Typical examples of the colorless compound forming coupler residue are represented by formulae (Xa), (XIa) or (XIIa):

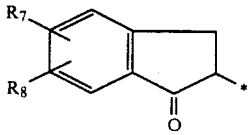
(Xa)

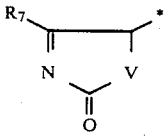
(XIa)

wherein * indicates the coupling position; $R_7$ represents a diffusion-resistant group containing a total of 8 to 32 carbon atoms, $R_8$ represents hydrogen, a halogen, a lower alkyl group or a lower alkoxy group, and V represents oxygen, sulfur or nitrogen; and

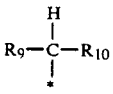
(XIIa)

wherein * indicates the coupling position; $R_9$ and $R_{10}$, which may be the same or different, each represents an alkoxycarbonyl 9group, an aminocarbonyl 9group, an acyl group, or a sulfonic acid or sulfinic acid derivative thereof; a cyano group; an ammoniumyl group; or a nitrogen-containing hetero ring linked to C via a nitrogen thereof; provided that $R_9$ and $R_{10}$ may be linked to form a 5-membered or 6-membered ring.

In addition to the above-described residues, $C_p$ may be a coupler residue capable of reacting with an oxidation product of a developing agent to form a black color. Examples thereof are described in, for example, U.S. Pat. Nos. 1,939,231, 2,181,944, 2,333,106, 4,126,461, West German Pat. No. (OLS) 2,644,194 and 2,650,764. Specific examples of these coupler residues are represented by formulae (XIIIa), (XIVa) and (XVa):

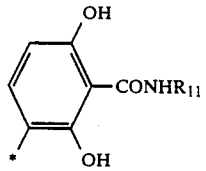
(XIIIa)

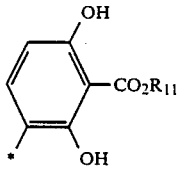
(XIVa)

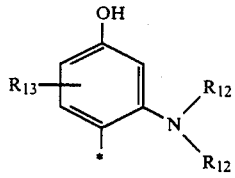
(XVa)

wherein * indicates the coupling position; $R_{11}$ represents an alkyl group containing 3 to 20 carbon atoms, an unsubstituted phenyl group or a phenyl group substituted with at least one hydroxyl group, halogen, amino group, alkyl group containing 1 to 20 carbon atoms, or alkoxy group; $R_{12}$ represents hydrogen, a halogen, an alkyl group containing 1 to 20 carbon atoms, an alkenyl group containing 1 to 20 carbon atoms, or an aryl group containing 6 to 20 carbon atoms, and plural $R_{12}$ groups may be the same or different; R13 represents a halogen, an alkyl group containing 1 to 20 carbon atoms, an alkoxy group containing 1 to 20 carbon atoms or a monovalent organic group, and plural $R_{13}$ groups may be the same or different.

Coupler residues ($C_p$) represented by the above formulae (Ia) to (XVa) may form polymers of two or more in polymerization degree, at a position other than the coupling position, or may be bonded to a polymer at a position other than the coupling position as described in, for example, U.S. Pat. Nos. 4,367,282, 4,409,320, 4,444,870, 4,436,808, 4,495,272, and 4,576,910.

In the formula (2), the coupler residue represented by $C_p$ is represented by formulae (Ia) to (XVa); BALL is bonded thereto in the asterisked position, and —(-TIME)$_n$—FA is bonded in one of the remaining positions.

In formula (2), the diffusiOn-resistant group represented by BALL has a size and form capable of making the coupler non-diffusible and may be a polymeric structure wherein a plurality of coupling-off groups are linked, or may contain an alkyl and/or aryl group capable of making the coupler non-diffusible as described in, for example, U.S. Pat. Nos. 3,558,700, 4,266,019, 4,282,312, 4,513,082, 3,894,875, and 3,664,841. In the latter case, the alkyl and/or aryl group preferably contains a total of about 8 to about 32 carbon atoms. BALL has a group for being bonded to the coupling position of $C_p$, and typical

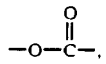

examples of such group include —0—, —S—, —N=N—,

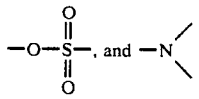

constituting a 5— to 7—membered hetero ring group. Examples of the hetero ring groups are

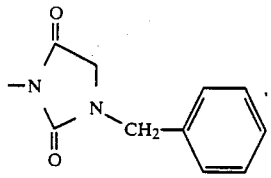

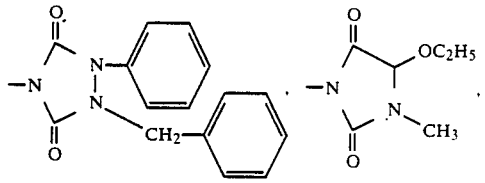

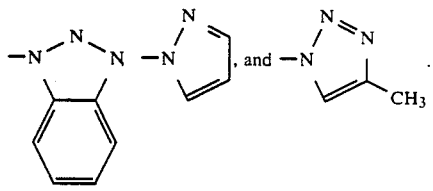

In compounds represented by formulae (1) or (2), $C_p$ is preferably a colorless compound forming coupler or a coupler capable of forming a diffusible dye upon coupling with an oxidation product of a developing agent.

In formula (3), the group represented by RED has a skeleton selected from hdroquinone, catechol, o-aminophenol and p-aminophenol and undergoes an oxidation-reduction reaction with an oxidation product of an aromatic primary amine developing agent and subsequently undergoes alkali hydrolysis to release —(-TIME)$_n$—FA (abbreviated as FR in formulae (XVIa) to (XXIa)).

Specific examples thereof are represented by formulae (XVIa) to (XIIa):

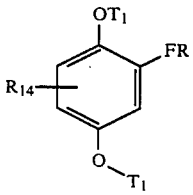
(XVIa)

-continued (XVIIa)

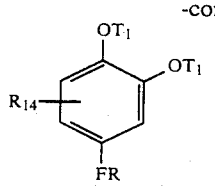

(XVIIIa)

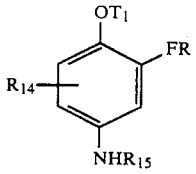

(XIXa)

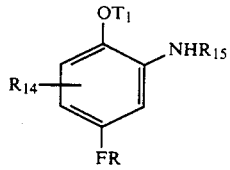

(XXa)

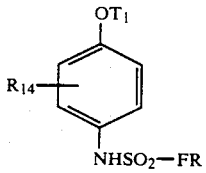

(XXIa)

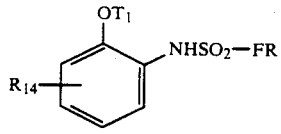

In the above formulae, $R_{14}$ represents at least one hydrogen, halogen, alkyl group, aryl group, alkoxy group, aryloxy group, alkylthio group, arylthio group, cyano group, alkoxycarbonyl group, carbamoyl group, sulfamoyl group, carboxyl group, sulfo group, sulfonyl group, acyl group, carbonamido group, sulfonamide group or heterocyclic group, and plural $R_{14}$ groups may be the same or different, provided that two $R_{14}$ groups in vic-positions may be linked to form a benzene ring or a 5- to 7-membered hetero ring. $R_{15}$ represents an alkyl group, an aryl group, an acyl group, a carbamoyl group, a sulfonyl group or sulfamoyl group. $T_1$ represents hydrogen or a group capable of being cleaved by hydrolysis under alkaline conditions, and plural $T_1$ groups may be the same or different. Typical examples of $T_1$ include hydrogen, an acyl group, a sulfonyl group, an alkoxycarbonyl group, a carbamoyl group, and an oxalyl group.

As the timing group represented by TIME, there are illustrated, for example, those which, after being eliminated from $C_p$ or RED by a coupling reaction or oxidation-reduction reaction, can release FA by an intramolecular substitution reaction as described in, for example, U.S. Pat. Nos. 4,248,962 and JP-A-57-56837; those which release FA by electron migration via a conjugation system as described in, for example, British Pat. Nos. 2,072,363A, JP-A-57-154234, JP-A-57-188035, JP-A-56-114946, JP-A-57-56837, JP-A-58-209736, JP-A-58-209737, JP-A-58-209738, JP-A-58-209740 and JP-A-58-98728, and those which are coupling components capable of releasing FA upon a coupling reaction with an oxidation product of an aromatic primary amine developing agent as described in JP-A-57-111536. These reactions may be one-stage reactions or multi-stage reactions.

As described above, trivalent TIME residues bonded to a coupling position, a non-coupling position, and FA are preferred. JP-A-58-209740 describes an example of incorporating such a TIME in yellow couplers.

With FA residues containing a group represented by AD—$(L)_m$—X, AD may be directly bonded to the carbon atom in the coupling position, or either L or X may be linked to the coupling carbon atom as long as they are eliminated by the coupling reaction. In addition, a two-equivalent coupling-off group may exist between the coupling carbon atom and AD. Examples of such groups include an alkoxy group (e.g., methoxy), an aryloxy group (e.g., phenoxy), an alkylthio group (e.g., ethylthio), an arylthio group (e.g., phenylthio), a heterocyclic oxy group (e.g., tetrazolyloxy), a heterocyclic thio group (e.g., pyridylthio), a heterocyclic group (e.g., hydantoinyl, pyrazolyl, triazolyl, or benzotriazolyl). Further, those groups described in British Pat. No. 2,011,391A may be used as FA.

As the group capable of adsorbing onto the surface of silver halide grains represented by AD, there may be illustrated, for example, a nitrogen-containing hetero ring having a dissociatable hydrogen atom (e.g., pyrrole, imidazole, pyrazole, triazole, teterazole, benzimidazole, benzopyrazole, benzotriazole, uracil, tetraazaindene, imidazotetrazole, pyrazolotriazole, or pentaazaidene), a hetero ring containing at least one nitrogen atom and another hetero atom (e.g., oxygen, sulfur or selenium) within the ring (e.g., oxazole, thiazole, thiazoline, thiazolidine, thiadiazole, benzothiazole, benzoxazole, or benzoselnazole), a mercapto group-containing hetero ring (e.g., 2-mercaptobenzothiazole, 2-mercaptopyrimidine, 2-mercaptobenzoxazole or 1-phenyl-5-mercaptotetrazole), a quaternary salt (e.g., a quaternary salt of, for example, tertiary amine, pyridine, quinoline, benzothiazole, benzimidazole, or benzoxazole), a thiophenol, an alhylthiol (e.g., cysteine), and a compound having the structure

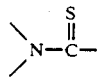

(e.g., a thiourea, dithiocarbamate, thioamide, rhodanine, thiazolidinethione, thiohydantoin or thiobarbituric acid).

The divalent linking group represented by L in FA is selected from alkylene, alkenylene, phenylene, naphthylene, —O—, —S—, —SO—, —$SO_2$—, —N=N—, carbonyl, amido, thioamido, sulfonamido, ureido, thioureido and hetero rings.

The fogging action of FA may be controlled or deactivated by properly selecting a group capable of being cleaved by the action of a component in a developer (for example, hydroxide ion, hydroxylamine or sulfite ion) as one of the divalent linking groups in L. Example of the group capable of being cleaved by the action of a component in a developer is a pheynyl ester group.

As examples of the group represented by X, there are illustrated, for example, reductive compounds (for example, hydrazine, hydrazide, hydrazone, hydroquinone, catechol, p-aminophenol, p-phenylenediamine, 1-phenyl-3-pyrazolidinone, enamine, aldehyde, polyamine, acetylene, aminoborane, quaternary salts such as tetrazolium salts or ethylene-bispyridinium salts or carbazinic acid) and those compunds which can form silver sulfide upon development (for example, compounds having the structure

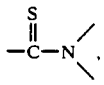

such as thiourea, thioamide, dithiocarbamate, rhodanine, thiohydantoin or thiazolidinethione). Of the groups represented by X, some groups which can form silver sulfide upon development themselves are capable of adsorbing onto the surface of silver halide grains, thus also functioning as an adsorptive AD.

Particularly preferred FA groups are represented by formulae (XXIIa) and (XXIIIa):

(XXIIa)

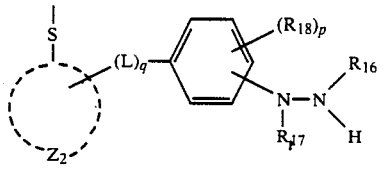

(XXIIIa)

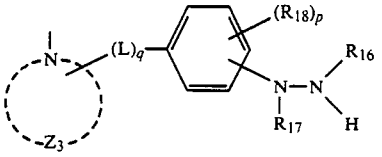

wherein $R_{16}$ represents an acyl group, a carbamoyl group, an alkylsulfonyl group, an arylsulfonyl group, an alkoxycarbonyl group, an aryloxycarbonyl group or a sulfamoyl group; $R_{17}$ represents hydrogen, an acyl group, an alkoxycarbonyl group, an alkylsulfonyl group, an arylsulfonyl group or an aryloxycarbonyl group; $R_{18}$ represents a halogen, an alkoxy group, an alkyl group, an alkenyl group, an aryl group, an aryloxy group, an alkylthio group, an arylthio group, a carbonamido group or a sulfonamido group, p is 0 or an integer of 1 to 4; and plural $R_{18}$ groups may be the same or different and may be linked to form a ring; L is a divalent linking group as defined in formula (4), q is 0 or 1; $Z_2$ represents an atomic group necessary for forming a monocyclic or condensed hetero ring, and $Z_3$ represents an atomic group necessary for forming a monocyclic or condensed hetero ring together with

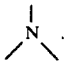

Specific examples of these groups are described in more detail below. As $R_{16}$, there are illustrated, for example, an acyl group (e.g., formyl, acetyl, propionyl, trifluoroacetyl, or pyruvoyl), a carbamoyl group (e.g., dimethylcarbamoyl), an alkylsulfonyl group (e.g., methane-sulfonyl), an arylsulfonyl group (e.g., benzenesulfonyl), an alkoxycarbonyl group (e.g., methoxycarbonyl), an aryloxycarbonyl group (e.g., phenoxycarbonyl) or a sulfamoyl group (e.g., methylsulfamoyl). As $R_{17}$, there are illustrated, for example, hydrogen, an acyl group (e.g., tribluoroacetyl) an alkoxycarbonyl group (e.g., methoxycarbonyl group), an alkylsulfonyl group (e.g., (methanesulfonyl), an arylsulfonyl group (e.g., benzen-sulfonyl) or an aryloxycarbonyl group (e.g., phenoxy-carbonyl). As $R_{18}$, there are illustrated, for example, a halogen (e.g., fluorine or chlorine), an alkoxy group (e.g., methoxy or methoxyethoxy), an alkyl group (e.g., methyl or hydroxymethyl), an alkenyl group (e.g., allyl), an aryl group (e.g., phenyl), an aryloxy group (e.g., phenoxy), an alkylthio group (e.g., methylthio), an arylthio group (e.g., phenylthio), a carbonamido group (e.g., acetamido) or a sulfonamido group (e.g., methanesulfon-amindo). Examples of

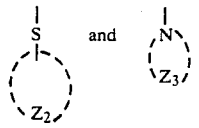

will be shown with respect to examples of AD described below.

Examples of the FR compounds used in the present invention are described in, for example, JP-A-57-150845, JP-A-59-50439, JP-A-59-157638, JP-A-59-170840, JP-A-60-37556, JP-A-60-107029 and JP-A-60-128446.

Examples of AD are shown below, but the present invention is not to be construed as being limited thereto. The free bonds are bonded to $-(L)_m-X$ and $-(TIME)_n-$.

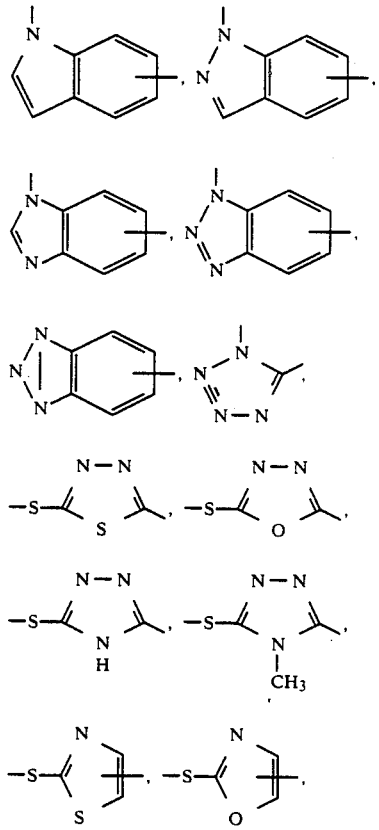

-continued
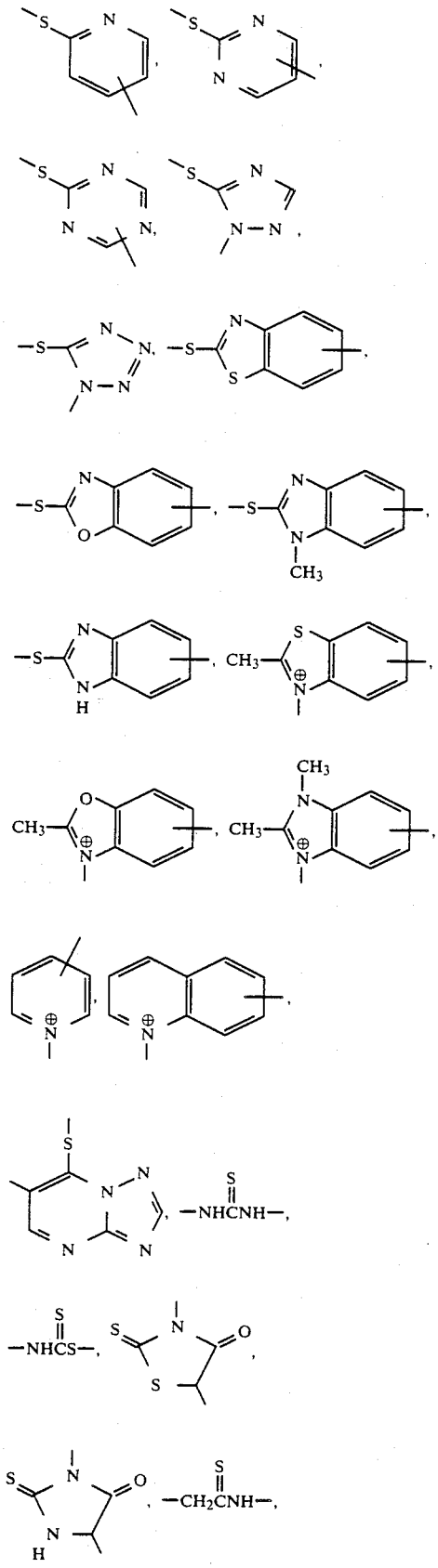
Examples of L are shown below, but the present invention is not to be construed as being limited thereto.
$-CH_2-$, $-CH_2CH_2-$, $-OCH_2-$, $-OCH_2CH_2-$, $-SCH_2-$, $-COO-$
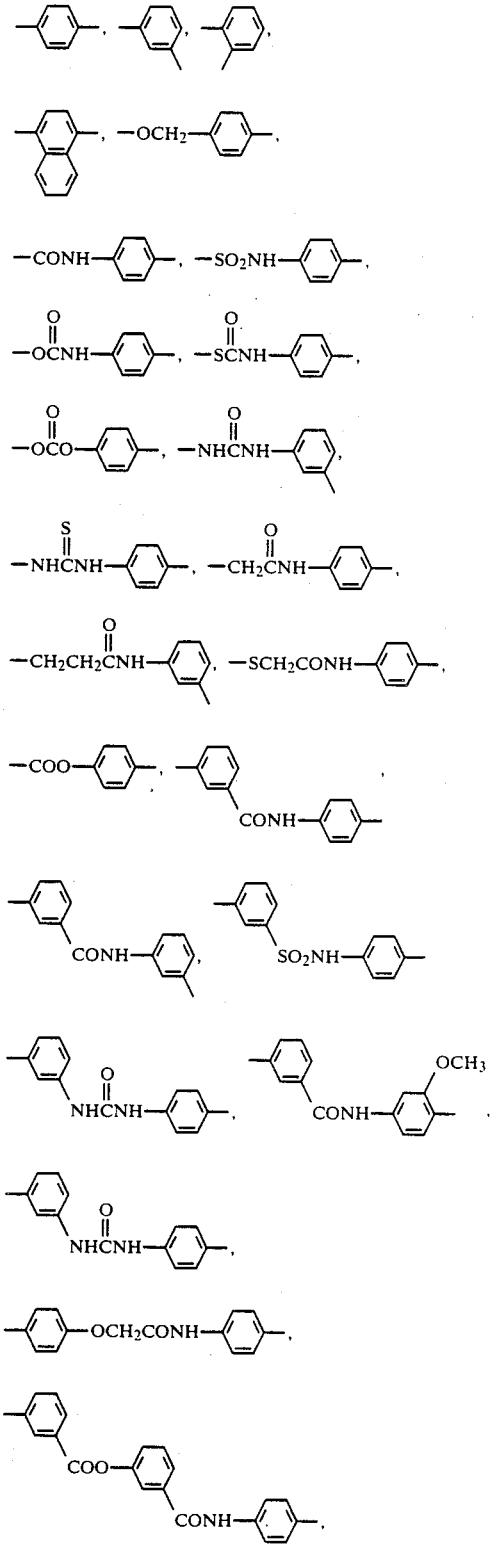

-continued
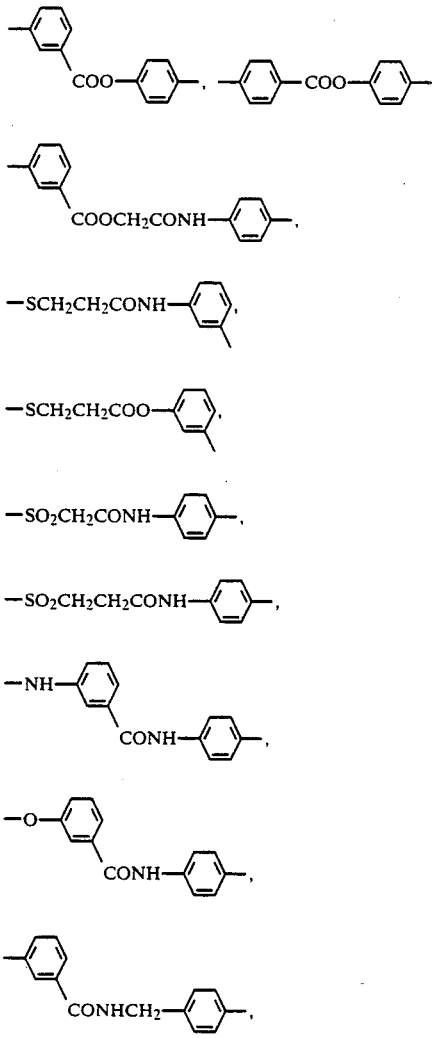
Examples of X are shown below, but the present invention is not to be construed as being limited thereto:
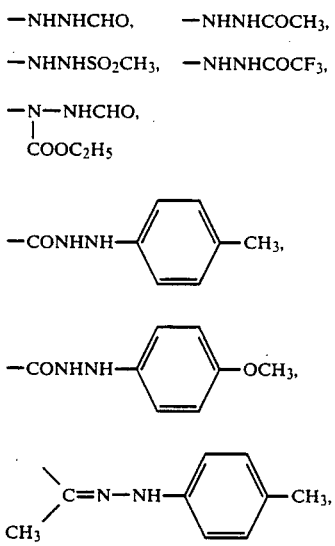
-continued
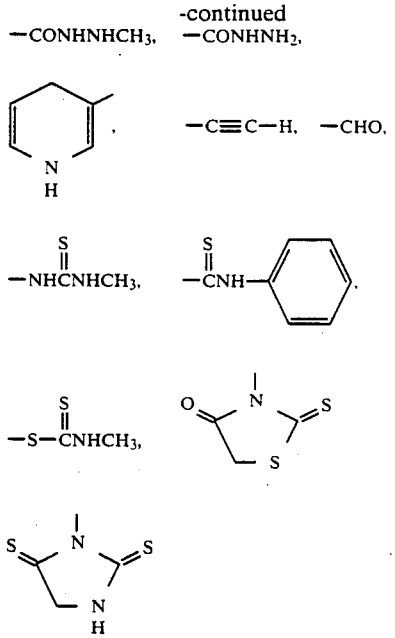
Specific preferred examples of FA in formulae (1) to (3) are shown below, but the present invention is not to be construed as being limited thereto:
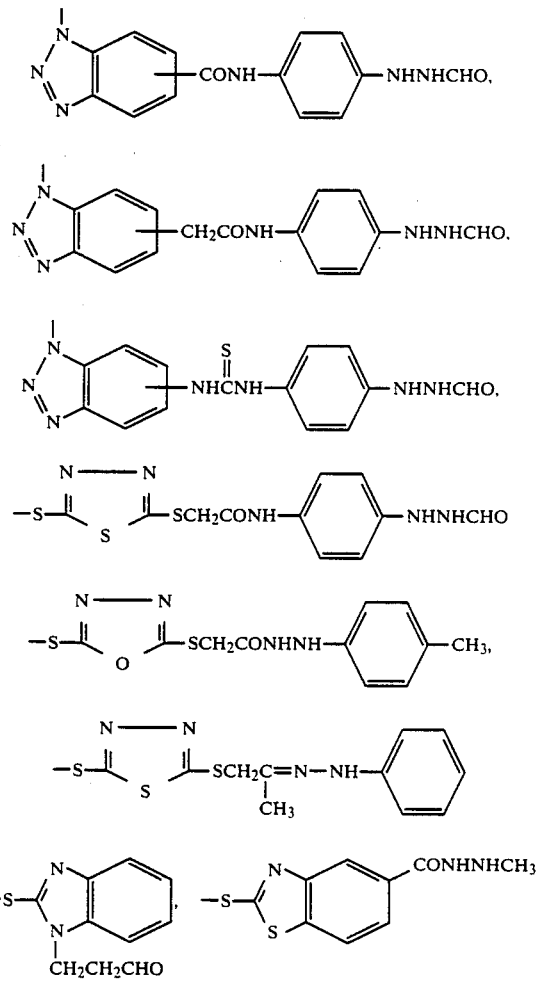

-continued
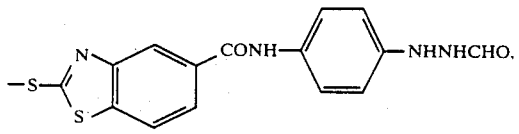
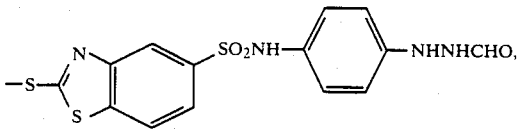
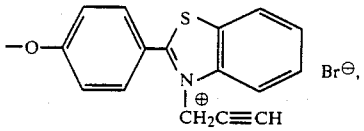
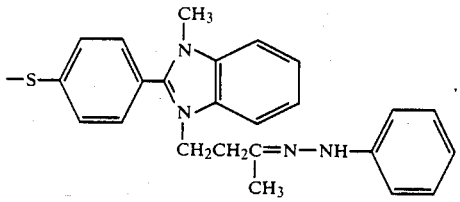
-continued
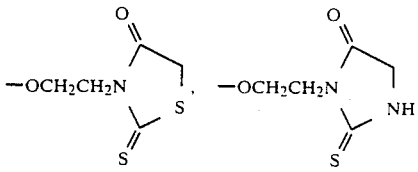
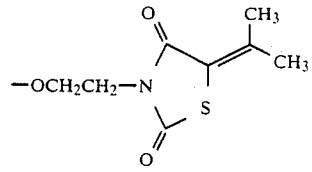
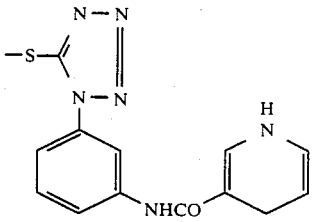
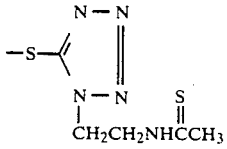
Specific examples of the compounds to be used in the present invention are illustrated below, but the present invention is not be construed as being limited thereto:
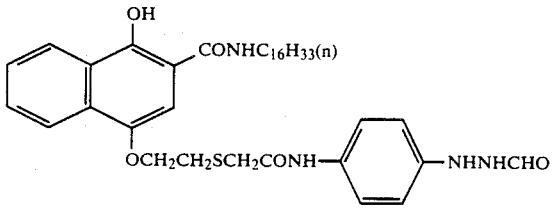
(1-1)
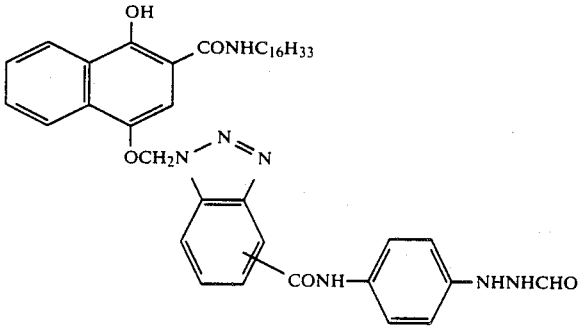
(1-2)

-continued
(1-3)
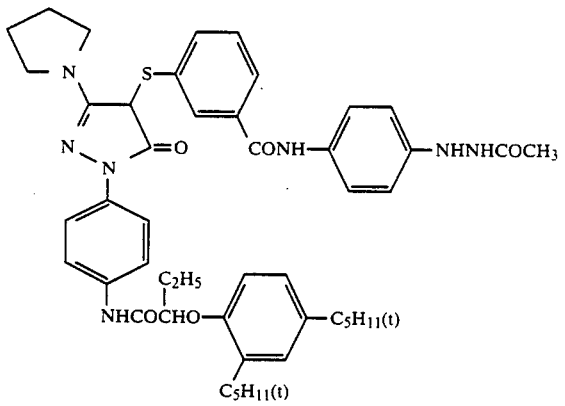
(1-4)
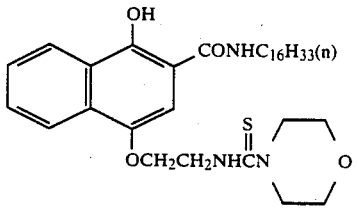
(1-5)
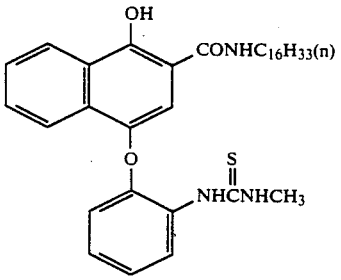
(1-6)
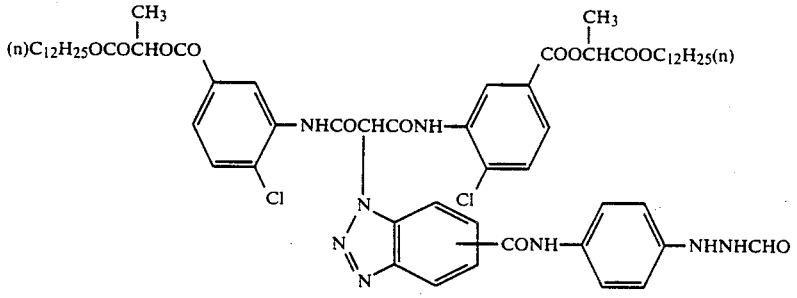
(1-7)
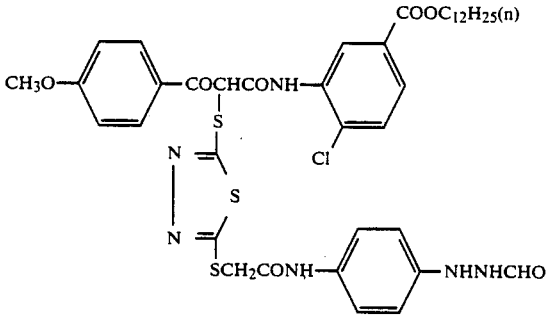

-continued
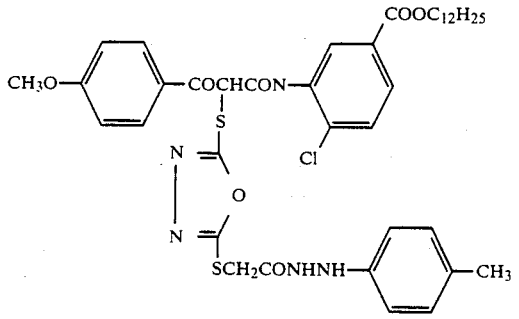
(1-8)
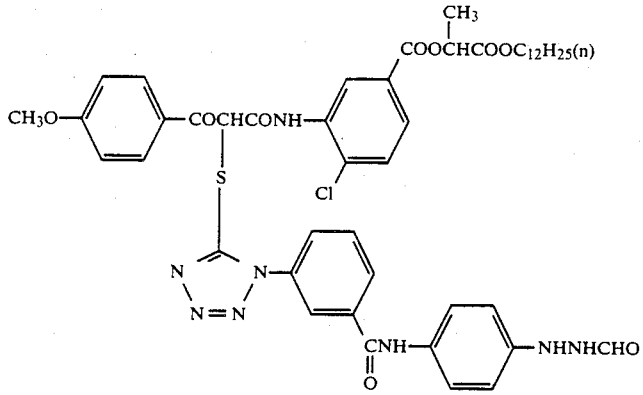
(1-9)
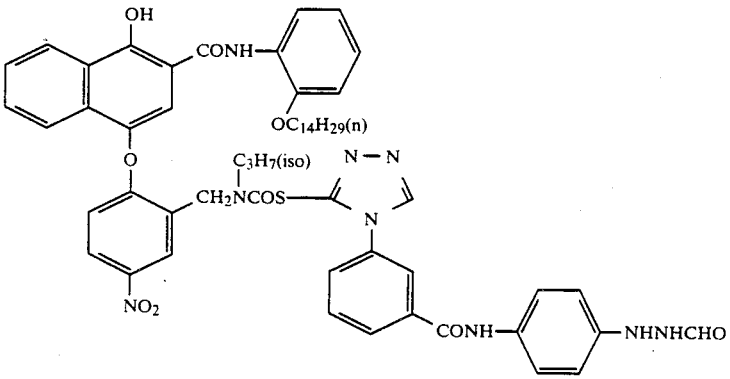
(1-10)
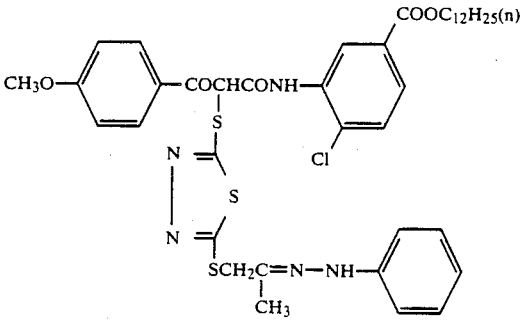
(1-11)

-continued
(1-12)
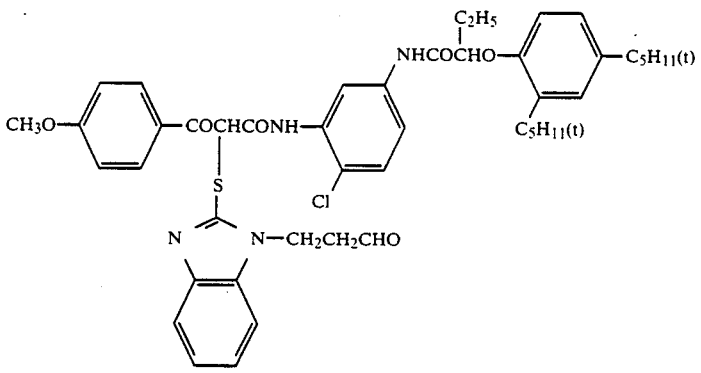
(1-13)
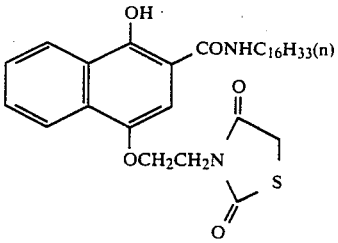
(1-14)
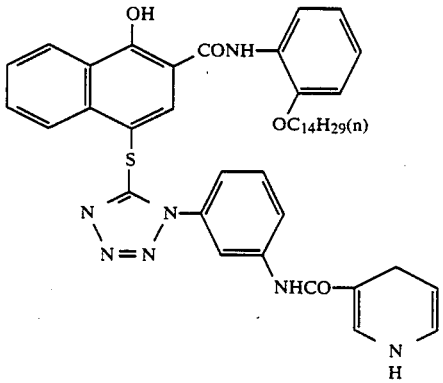
(1-15)
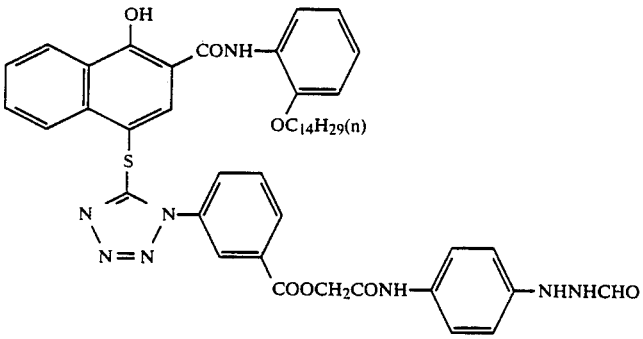
(1-16)
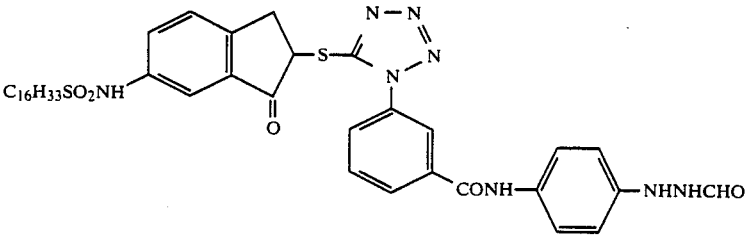

-continued
(1-17)
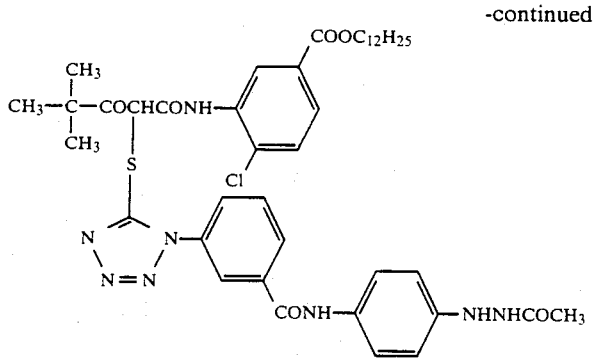
(1-18)
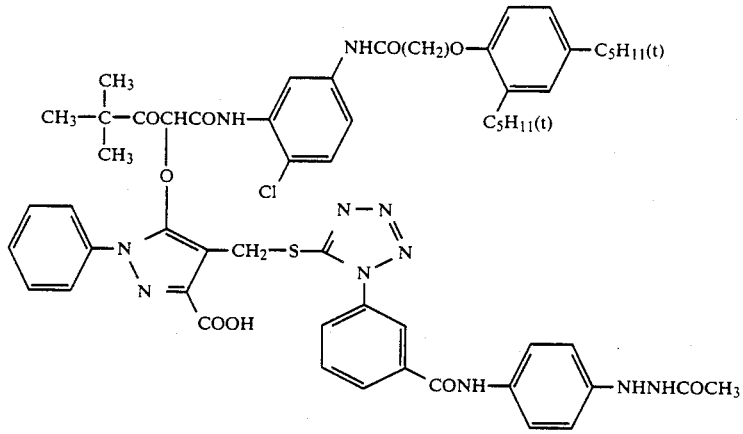
(1-19)
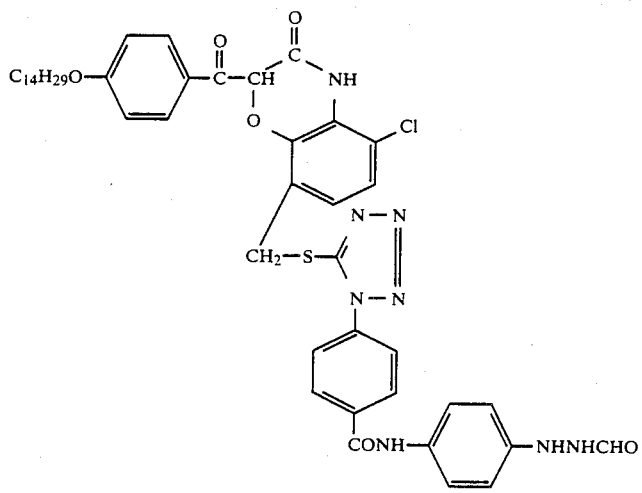
(1-20)
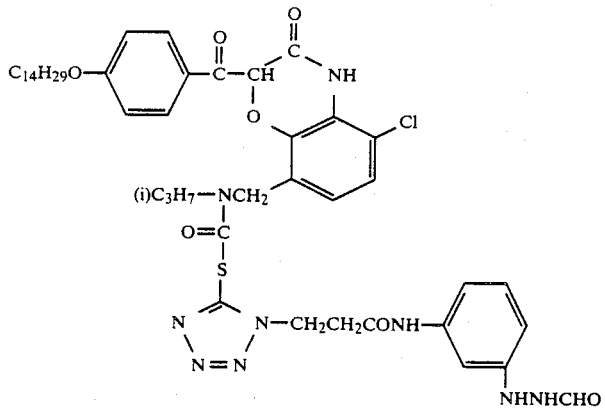

-continued
(1-21)
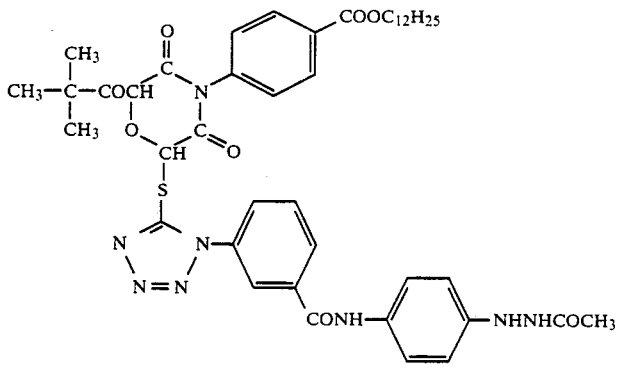
(1-22)
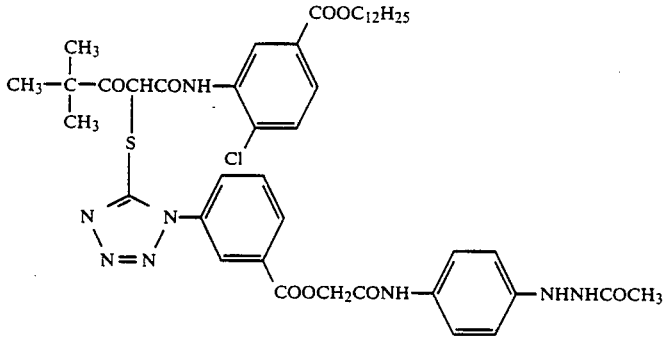
(1-23)
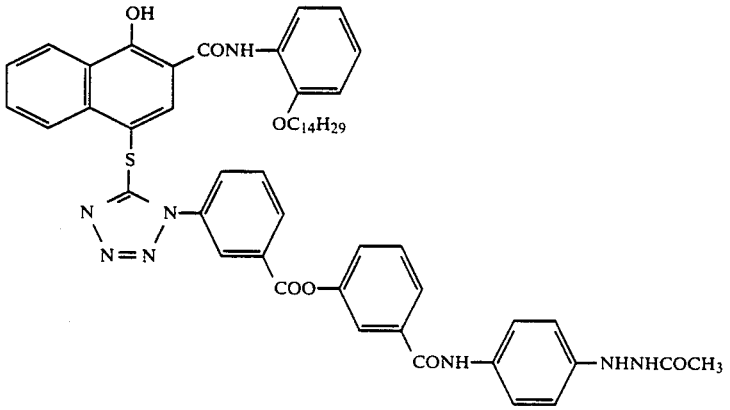
(1-24)
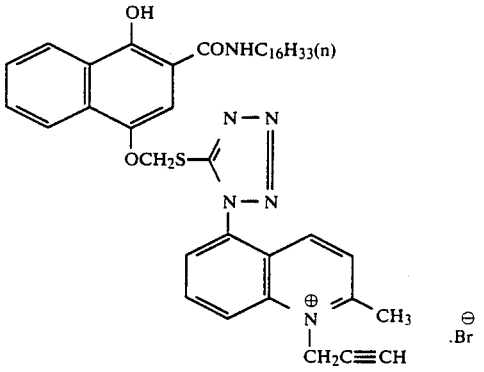

-continued
(1-25)
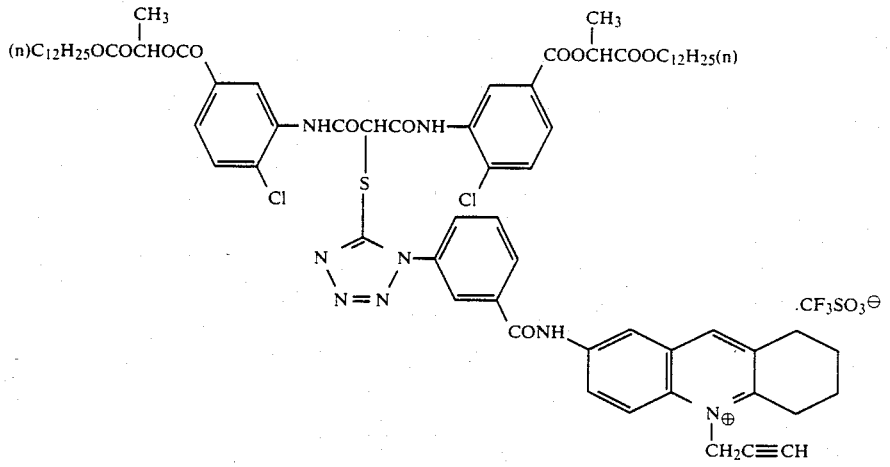
(1-26)
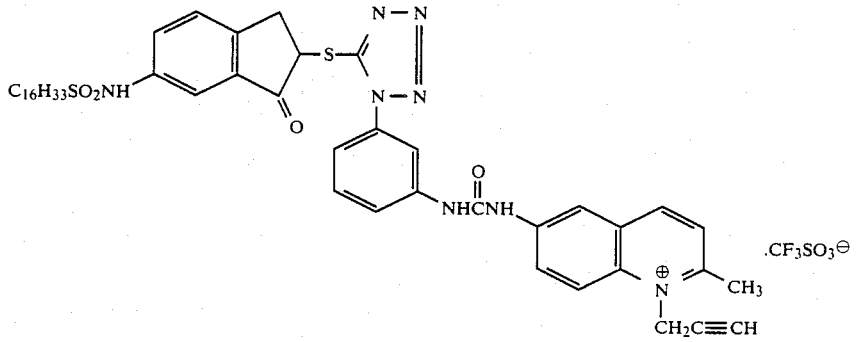
(1-27)
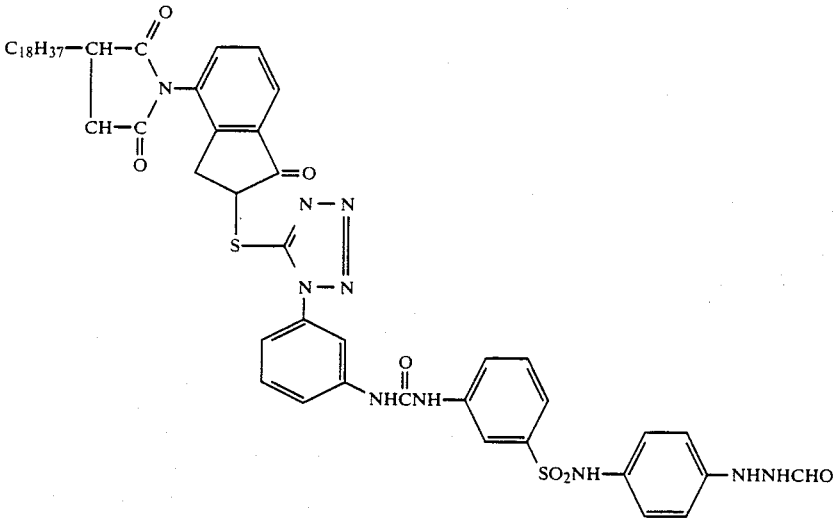

-continued
(1-28)
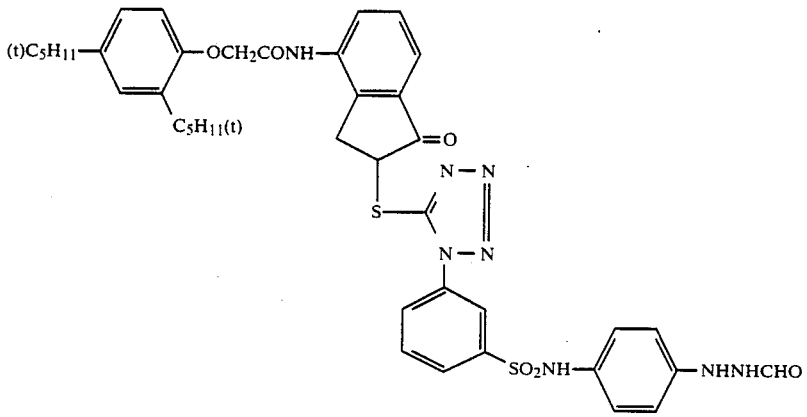
(1-29)
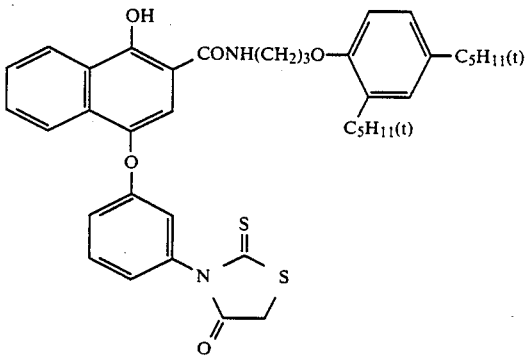
(2-1)
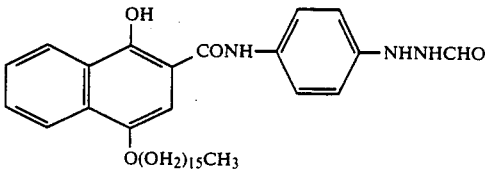
(2-2)
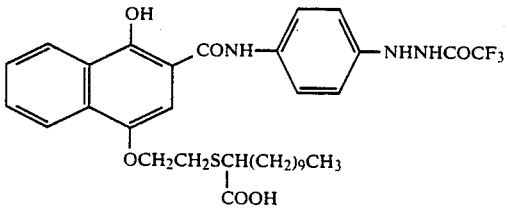
(2-3)
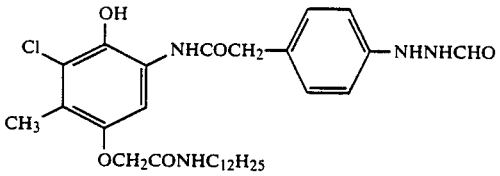
(2-4)
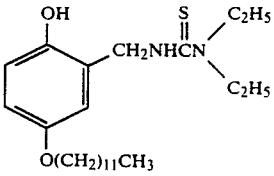

-continued
(2-5)
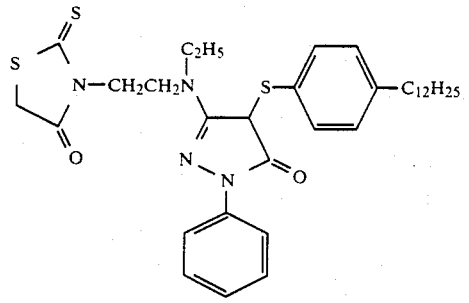
(2-6)
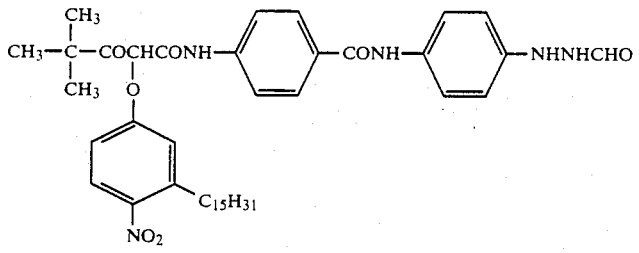
(2-7)
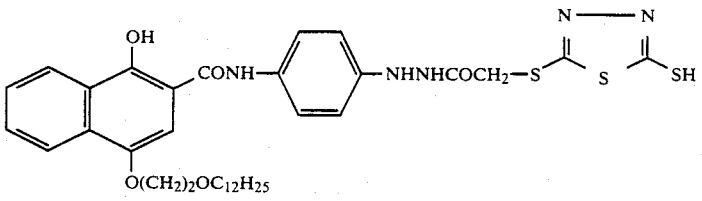
(2-8)
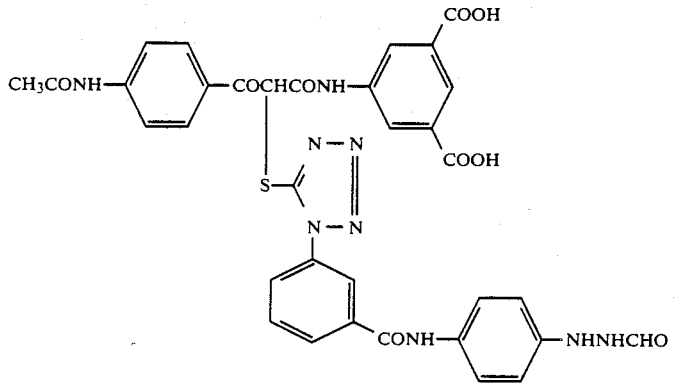
(2-9)
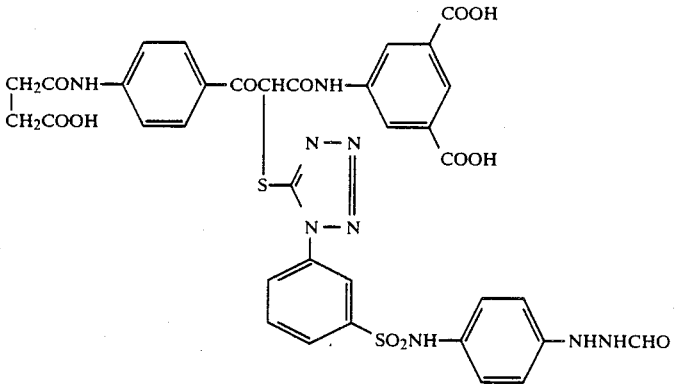

-continued
(2-10)
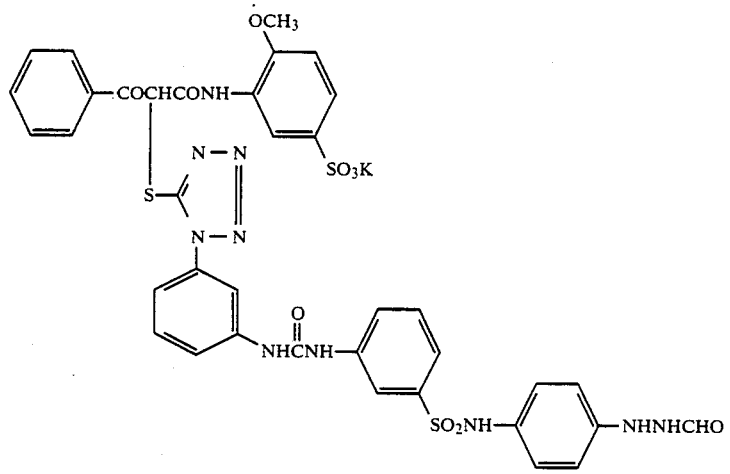
(2-11)
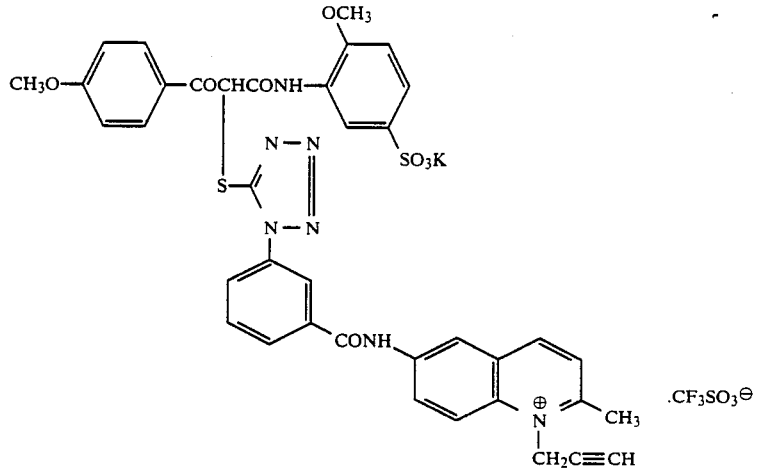
(2-12)
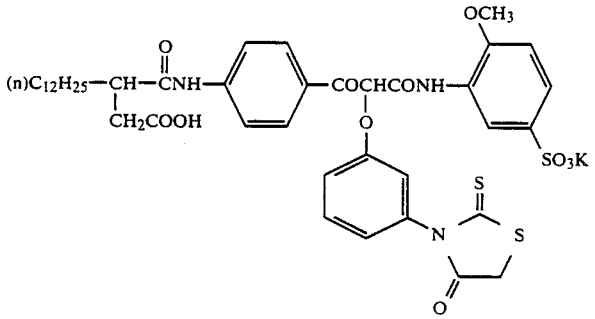
(2-13)
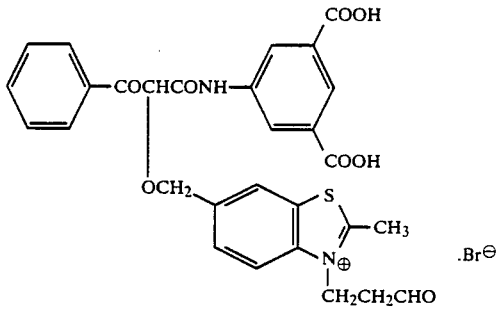

-continued
(2-14)
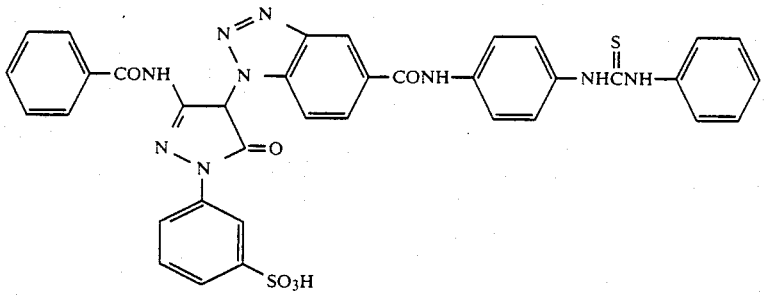
(2-15)
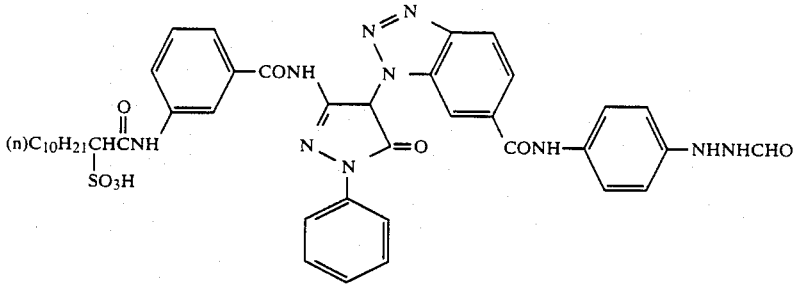
(2-16)
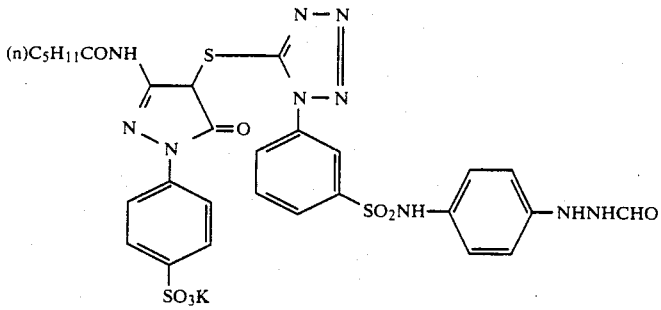
(2-17)
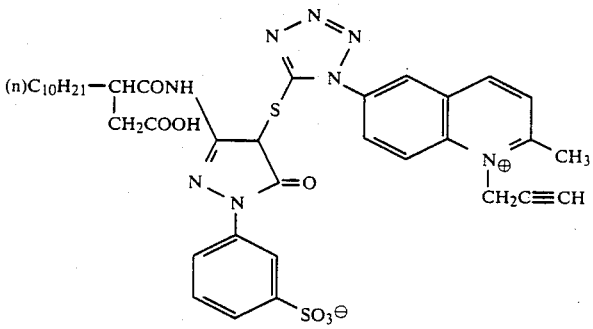
(2-18)
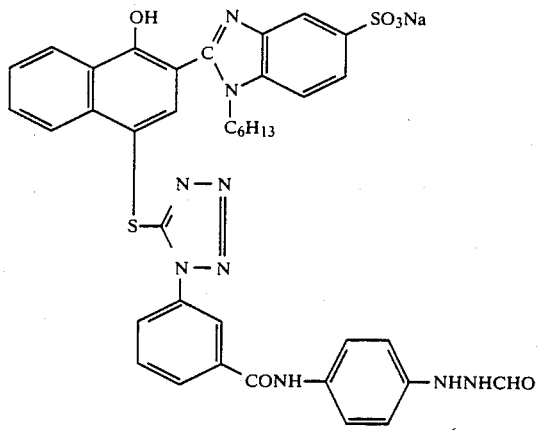

-continued
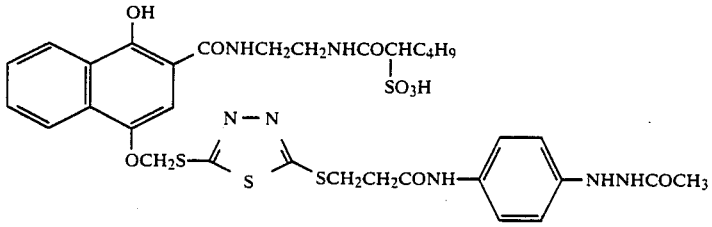
(2-19)
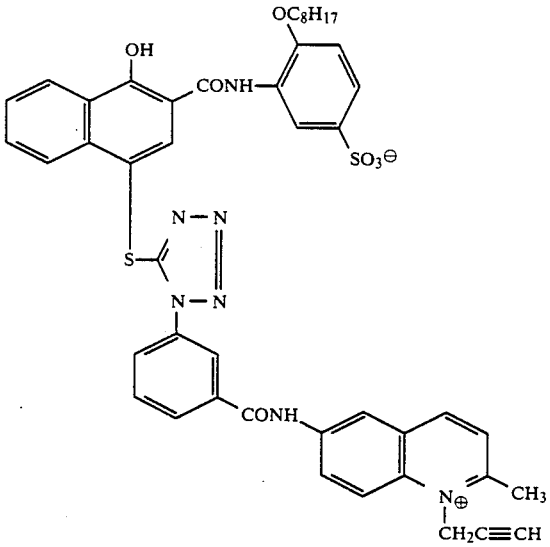
(2-20)
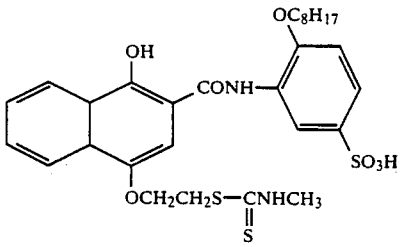
(2-21)
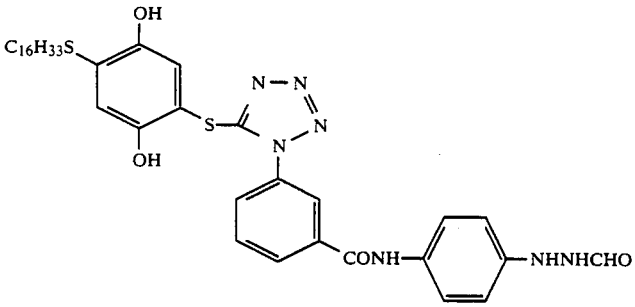
(3-1)
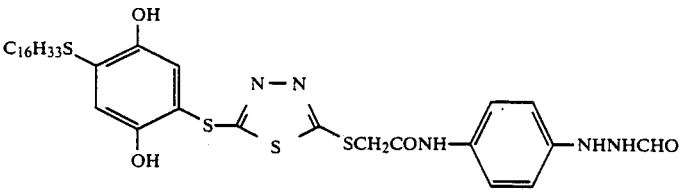
(3-2)

-continued
(3-3)
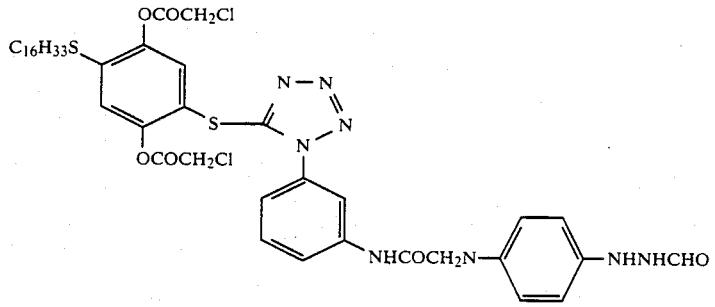
(3-4)
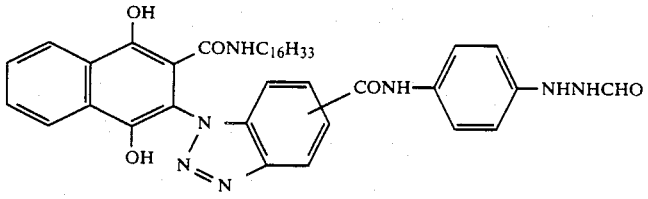
(3-5)
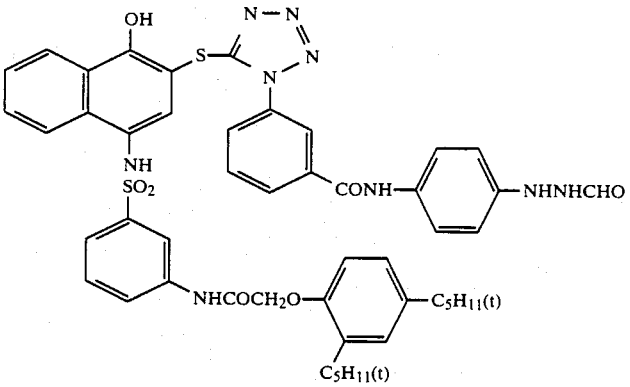
(3-6)
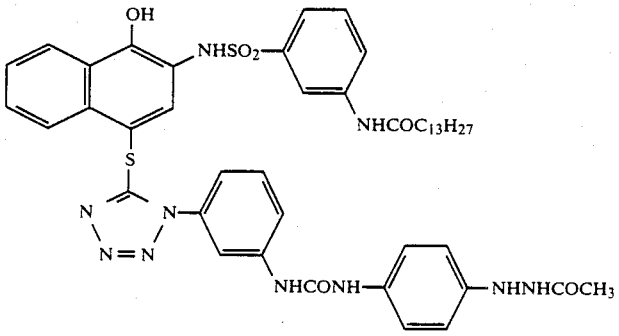
(3-7)
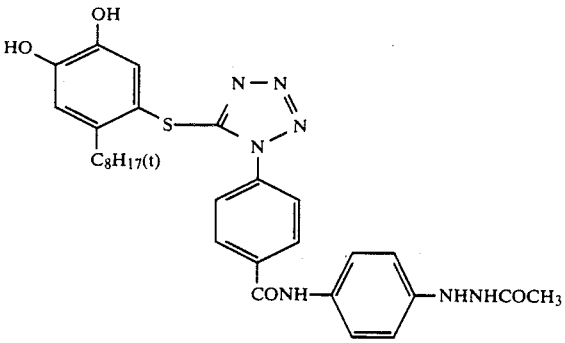

-continued
(3-8)
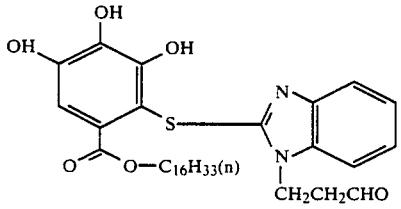
(3-9)
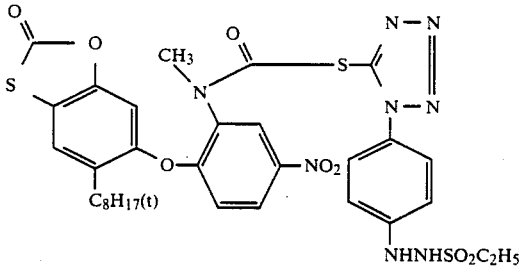
(3-10)
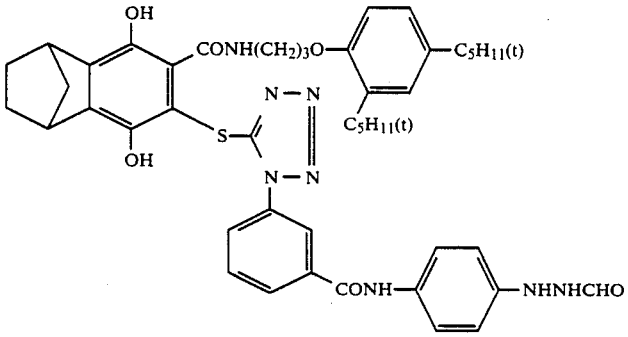
(3-11)
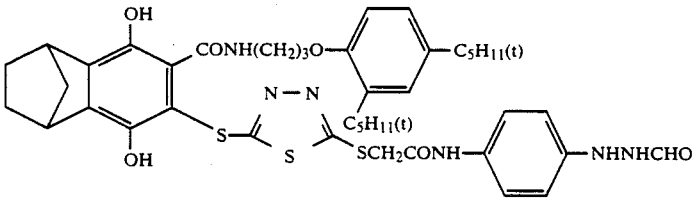
(3-12)
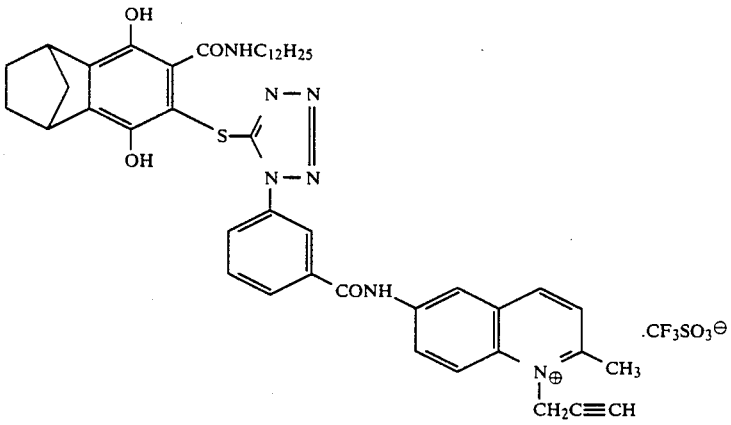

-continued (3-13)

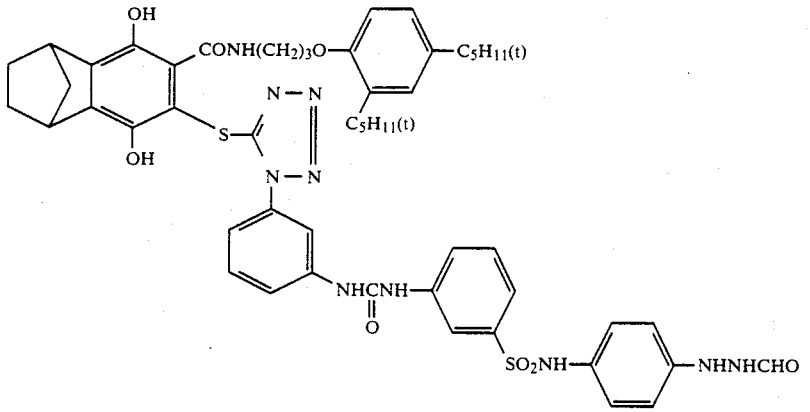

The FR compounds to be used in the present invention are added in amounts of $10^{-9}$ to $10^{-1}$ mol, preferably $10^{-8}$ mol to $10^{-2}$ mol, per mol of silver halide contained in the FR compound-containing layer or its adjacent layer.

In the present invention, the FR compounds may be incorporated in silver halide emulsion layers in a known manner, for example, according to the process described in U.S. Pat. No. 2,322,027. For example, they are dissolved in, for example, an alkyl phthalate (e.g., dibutyl phthalate or dioctyl phthalate), a phosphoric acid ester (e.g., diphenyl phosphate, triphenyl phosphate, tricresyl phosphate or dioctylbutyl phosphate), a citric acid ester (e.g., tributyl acetylcitrate), a benzoic acid ester (e.g., octyl benzoate), an alkylamide (e.g., diethyl-laurylamide), a fatty acid ester (e.g., dibutoxyethyl succinate or diethyl azelate) a trimesic acid ester (e.g., tributyl trimesate) or in an organic solvent having a boiling point of about 30 ° C. to 150 ° C. such as a lower alkyl acetate (e.g., ethyl acetate or butyl acetate), ethyl propionate, sec-butyl alcohol, methyl isobutyl ketone, 8-ethoxyethyl acetate or methylcellosolve acetate, then dispersed in a hydrophilic colloid. The above-described high-boiling organic solvents and the low-boiling organic solvents may be used as a mixture.

In addition, dispersing processes using a polymer described in JP-B-51-39853 and JP-A-51-59943 may also be employed.

FR compounds having an acid group such as a carboxylic acid or a sulfonic acid group are introduced into a hydrophilic colloid as an alkaline aqueous solution.

The term "internal latent image-forming silver halide emulsion containing non-prefogged silver halide grains" as used herein refers to an emulsion containing silver halide grains whose surface is not previously fogged and which form a latent image mainly within the interior of the grain. More specifically, a silver halide emulsion which, when coated on a transparent support in a given amount, exposed for a fixed time of 0.01 to 10 seconds, and developed at 18 ° C. for 5 minutes in the following developer A (internal developer), gives a maximum density measured according to a conventional method of measuring photographic density of at least 5 times, more preferably at least 10 times, the density obtained when coated and exposed in the same manner and developed at 20 ° C. for 6 minutes in the following developer B (surface developer) is preferred.

| | |
|---|---|
| Internal developer A: | |
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water to make | 1 liter |
| Internal developer B: | |
| Metol | 2.5 g |
| l-Ascorbic acid | 10 g |
| $NaBO_2 \cdot 4H_2O$ | 35 g |
| KBr | 1 g |
| Water to make | 1 liter |

As the specific examples of the internal latent image-forming emulsion, there are illustrated, for example, conversion type silver halide emulsions described in U.S. Pat. No. 2,592,250 and core/shell type silver halide emulsions described in U.S. Pat. Nos. 3,761,276, 3,850,637, 3,923,513, 4,035,185, 4,395,478 and 4,504,570, JP-A-52-156614, JP-A-55,127549, JP-A-53,60222, JP-A-56,22681, JP-A-59-208540, JP-A-60-107641, JP-A-61-3137, and *Research Disclosure*, No. 23510 (Nov., 1983), p. 236. The internal latent image-formig emulsion may be either a conversion type emulsion or a core/shell type emulsion, with the latter being preferred.

The silver halide grains to be used in the present invention may have a regular crystal form such as cubic, octahedral, dodecahedral or tetradecahedral, or an irregular crystal form such as spherical, or may be tabular grains having a length/thickness ratio of 5 or more. In addition, emulsions containing silver halide grains having a composite form of these various crystal forms or containing a mixture of silver halide grains having different crystal forms may also be used.

The composition of the silver halide may be silver chloride, silver bromide, and mixed silver halides. Silver halides used preferably in the present invention are silver chlorobromide, silver chlorobromoiodide, silver chloride, silver chloroiodide, silver bromide, and silver bromoiodide optionally containing up to 3 mol % silver iodide.

As to the average silver halide grain size, a size of not larger than 2 μm and not smaller than 0.1 μm is preferable, with a size not larger than 1 μm and not smaller than 0.15 μm being particularly preferred. The grain size distribution may be narrow or broad but, in order to improve, for example, graininess or sharpness, monodisperse silver halide emulsions are preferably used in the present invention, which have a narrow grain size distribution such that 90% or more in number or by weight of the whole grains are within the range of the average grain size ±40%, particularly preferably ±20%. In order to attain the intended gradation of a light-sensitive material, two or more monodisperse silver halide emulsions having different grain sizes or two or more kinds of grains of the same grain size having different sensitivities may be used as a mixture in one layer, or may be separately incorporated in different layers having substantially the same color sensitivity. In addition, a combination of two or more polydisperse silver halide emulsions or a combination of a monodisperse emulsion and a polydisperse emulsion may be used as a mixture in one layer or separately in different layers.

The internal part of surface of the silver halide grains in the emulsion to be used in the present invention may be chemically sensitized by applying thereto a sulfur or selenium sensitization process, a reduction sensitization process or a noble metal sensitization process independently or in combination. Detailed specific examples thereof are described in the patents referred to in, for example, *Research Disclosure*, No. 17643-III (issued in Dec., 1978), p. 23.

A silver coverage per one internal latent image-forming silver halide emulsion layer of the present invention is preferably from $10^{-3}$ to 10 g/m$^2$, particularly preferably from 10−2 to 5 g/m$^2$.

A silver coverage per one negative-working silver halide emulsion layer of the present invention is preferably from 10−4 to 10 g/m$^2$, particularly preferably from 10−3 to 1 g/m$^2$.

The silver halide preferably used in the negative-working silver halide emulsion used in the present invention may be any of silver bromoiodide, silver chloroiodide or silver chlorobromoiodide containing up to about 10 mol% of silver iodide, and pure silver bromide, silver chlorobromide, and pure silver chloride. The content of silver iodide is preferably less than 5 mol%.

The silver halide grains to be used in the negative-working photographic emulsion may have a regular crystal form such as cubic, octahedral or tetradecahedral, an irregular form such as spherical or tabular, may be grains having a crystal defect such as a twinning plane, or may be a composite form thereof.

The silver halide grains may be fine grains having a grain size of not larger than about 0.1 μm or large grains having a grain size of up to about 10 μm in projected area diameter, and may be of polydisperse type or monodisperse type.

The negative-working silver halide photographic materials to be used in the present invention may be prepared according to the processes described in, for example, *Research Disclosure*, No. 17643 (Dec., 1978), pp. 22 to 23, "I. Emulsion preparation and types", and *ibid.*, No. 18716 (Nov., 1979), p. 648, P. Glafkides; *Chimie et Physique Photographique* (Paul Montel, 1967), G. F. Duffin; *Photographic Emulsion Chemistry* (Focal Press, 1966), V. L. Zelikman et al; *Making and Coating Photographic Emulsion* (Focal Press, 1964).

Monodisperse emulsions described in, for example, U.S. Pat. Nos. 3,574,628 and 3,655,394 and British Pat. No. 1,413,748 are also preferred. Tabular grains of not less than about 5 in aspect ratio may also be used in the present invention. Such tabular grains may be easily prepared according to processes described in, for example, Gutoff; *Photographic Science and Engineering*, vol. 14, pp. 248 to 257 (1970), U.S. Pat. Nos. 4,434,226, 4,414,310, 4,433,048 and 4,439,520 and British Pat. No. 2,112,157.

The crystal structure may be uniform or a structure wherein the inner portion and the outer portion differ from each other in halide composition, or a layered structure. Further, silver halide crystals different from each other in composition may be joined by an epitaxial junction, or silver halide grains may be joined to other compounds than silver halide, such as silver rhodanide or lead oxide, or a mixture of grains of various crystal forms may be used.

Negative-working silver halide emulsions are usually subjected to physical ripening, chemical ripening and spectral sensitization before use. Additives to be used in these steps are described in *Research Disclosure* Nos. 17643 and 18716.

The internal latent image-forming emulsion and the negative-working photographic emulsion to be used in the present invention are spectrally sensitized with photographic sensitizing dyes in a conventional manner. Particularly useful dyes are cyanine dyes, merocyanine dyes, and complex merocyanine dyes. These dyes may be used alone or in combination. The dyes may be used in combination with supersensitizing dyes. Detailed specific examples are described in the patents referred to in, for example, *Research Disclosure*, No. 17643-IV (Dec., 1978), pp. 23 to 24.

The internal latent image-forming emulsion and the negative-working photographic emulsion used in the present invention may contain an antifogging agent or a stabilizer for the purpose of preventing fogging or for stabilizing photographic properties in the steps of preparing, or during storage or photographic processing of the light-sensitive materials. Detailed specific examples are described in, for example, *Research Disclosure* No. 17643-VI (Dec., 1978) and E. J. Birr; *Stabilization of Photographic Silver Halide Emulsions* (Focal Press, 1974).

Various color couplers may be used for forming direct positive color images. Useful color couplers are compounds which undergo a coupling reaction with an oxidation product of an aromatic primary amine color-developing agent to produce or release a substantially non-diffusible dye and which themselves are non-diffusible compounds. Typical examples of useful color couplers include naphtholic or phenolic compounds, pyrazolone or pyrazoloazole type compounds, and open-chain or heterocyclic ketomethylene compounds. Specific examples of these cyan, magenta and yellow couplers to be used in the present invention are described in *Research Disclosure*, No. 17643 (1978, Dec.), p. 25, Item VII-D, *ibid.*, 18717 (Nov., 1979) and JP-A-61-32462, and the patents cited therein.

Of these couplers, oxygen atom coupling-off type and nitrogen atom coupling-off type yellow 2-equivalent couplers are typical examples of yellow couplers to be used in the present invention. In particular, α-pivaloylacetanilide type couplers are excellent in fastness, particularly light fastness, of color dyes, and α-benzoylacetanilide type couplers provide high color density, thus being preferred.

5-Pyrazolone type magenta couplers preferably used in the present invention are 5-pyrazolone type couplers substituted by an arylamino group or an acylamino group in the 3-position (particularly, sulfur atom coupling-off type 2-equivalent couplers).

More preferred couplers are pyrazoloazole type couplers, with pyrazolo[5,1-c][1,2,4]triazoles described in U.S. Pat. No. 3,725,067 being particularly preferred. Imidazo[1,2-b]pyrazoles described in U.S. Pat. No. 4,500,630 are still more preferred due to small yellow side absorption and the light fastness of formed dyes, with pyrazolo[1,5-b][1,2,4]triazoles described in U.S. Pat. No. 4,540,654 being particularly preferred.

Cyan coulers preferably used in the present invention are naphtholic or phenolic couplers described in, for example, U.S. Pat. Nos. 2,474,293 and 4,052,212 and phenolic cyan couplers having an alkyl group containing 2 or more carbon atoms in the m-position of the phenol nucleus, described in U.S. Pat. No. 3,772,002. In addition, 2,5-diacylamino-substituted phanolic couplers are also preferred for forming color images with good fastness.

Colored couplers for correcting unnecessary absorptions in shorter wave-length regions of formed dyes, couplers forming colored dyes with a proper diffusibility, colorless compound forming couplers, DIR couplers capable of releasing a development inhibitor upon a coupling reaction, couplers capable of releasing the same development promoter as that of FA, or polymerized couplers may also be used.

Typical amounts of color couplers to be used range from 0.001 to 1 mol per mol of light-sensitive silver halide, preferably from 0.01 to 0.5 mol with respect to yellow couplers, from 0.003 to 0.3 mol with respect to magenta couplers, and from 0.002 to 0.3 mol with respect to cyan couplers.

Coloration-intensifying agents may be used in the present invention for improving color-forming properties of couplers. Typical examples of such compounds are described in JP-A-62-215272, pp. 374 to 391.

In adding the couplers of the present invention to an emulsion layer, they are dissolved in a high-boiling and/or low-boiling organic solvent, the solution is emulsified and dispersed in a hydrophilic colloidal aqueous solution, such as a gelatin aqueous solution, by high-speed stirring using for example, a homogenizer, by mechanical atomization using for example, a colloid mill, or by utilizing ultrasonic waves, and the resulting emulsion dispersion is added to an emulsion layer. In this case, the high-boiling organic solvent is not always necessary, but the use of the compounds described in JP-A62-215272, pp. 440 to 467 is preferred.

The couplers of the present invention may be dispersed in a hydrophilic colloid according to the process described in JP-A-62-215272, pp. 468 to 475.

The light-sensitive material prepared according to the present invention may contain, for example, hydroquinone derivatives, aminophenol derivatives, amines, gallic acid derivatives, catechol derivatives, ascorbic acid derivatives, colorless compound forming couplers and sulfonamidophenol derivatives as color fog-preventing agents or color mixing-preventing agents.

Typical examples of the color fog-preventing agents and color mixing-preventing agents are described in JP-A-62-215272, pp. 600 to 630.

Various anti-fading agents may be used in the light-sensitive material of the present invention. As typical organic anti-fogging agents, there are illustrated, for example, hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines, and ether or ester derivatives thereof obtained by silylation or alkylation of the phenolic hydroxy groups of these compounds. In addition, metal complexes represented by (bissalicylaldoximato)nickel complexes and (bis-N,N-dialkyldithiocarbamato)nickel complexes may also be used.

Compounds having both hindered amine and hindered phenol structures in the same molecule as described in U.S. Patent 4,268,593 give good results with respect to prevention of deterioration of yellow dye images by heat, humidity and light. Spiroindanes described in JP-A-56-159644 and hydroquinone diether- or monoether-substituted chromans described in JP-A-55-89835 give preferred results with respect to prevention of deterioration of the magenta dye image by, particularly, light.

Typical examples of these anti-fading agents are described in JP-A-62-215272, pp. 401 to 440. For fading prevention, these compounds are added to a light-sensitive layer in amounts of usually 5 to 100 wt% based on corresponding couplers by the technique of coemulsifying with couplers. In order to prevent deterioration of the cyan dye image by heat and, particularly, light, incorporation of an ultraviolet absorbent in both layers adjacent to the cyan color layer is effective. In addition, the ultraviolet absorbent may be added to such hydrophilic colloidal layers as protective layers. Typical examples of the compounds are described in JP-A-62-215272, pp. 391 to 400.

As binders or protective colloids to be used in the emulsion layers and interlayers of the light-sensitive material of the present invention, gelatin is advantageously used. However, other hydrophilic colloids may also be used.

To the light-sensitive material of the present invention may be added, for example, dyes capable of preventing irradiation or halation, ultraviolet absorbents, plasticizers, brightening agents, matting agents, air fog-preventing agents, coating aids, hardeners, antistatic agents, and slipping properties-improving agents. Typical examples of these additives are described in *Research Disclosure*, No. 17643, Item VIII to XIII (Dec., 1978), pp. 25 to 27 and ibid., No. 18716 (Nov., 1979), pp. 647 to 651.

The present invention may also be applied to a multi-layered, multi-color photographic material composed of a support having thereon at least two layers different from each other in spectral sensitivity. Multi-layered, natural color photographic materials usually are composed of a support having thereon at least one red-sensitive emulsion layer, at least one green-sensitive emulsion layer, and at least one blue-sensitive emulsion layer. The order of these layers may be optionally selected as desired. Preferably, the layers are provided in the order of a red-sensitive layer, a green-sensitive layer, and a blue-sensitive layer, or in the order of a green-sensitive layer, a red-sensitive layer, and a blue-sensitive layer, from the support. Each emulsion layer described above may contain two or more emulsion layers having different sensitivities, and a light-insensitive layer may be provided between two or more emulsion layers having the same color sensitivity. The red-sensitive internal latent image-forming emulsion layer usually contains a cyan-forming coupler, the green-sensitive internal latent image-forming emulsion layer a magenta-forming layer and the blue-sensitive internal latent image-forming emulsion layer a yellow-forming coupler. However, in some cases, different combinations may be employed.

In the light-sensitive material in accordance with the present invention, auxiliary layers such as protective layers, interlayers, filter layers, antihalation layers, backing layers and white reflecting layers may be preferably be properly provided.

The light-sensitive material in accordance with the present invention may comprise a support having thereon an interlayer (optional), a red-sensitive internal latent image-forming silver halide emulsion layer, an interlayer (optional), a green-sensitive internal latent image-forming silver halide emulsion layer, an interlayer (optional), a red-sensitive surface latent image-forming, negative-working silver halide emulsion layer, an interlayer (optional), a yellow filter layer, an interlayer (optional), a blue-sensitive internal latent image-forming silver halide emulsion layer and a protective layer in this order.

The photographic emulsion layers and other layers of the light-sensitive material of the present invention are coated on a supported described in, for example, *Research Disclosure* No. 17643, Item XVII (dec., 1978), p. 28, European Pat. No. 0,182,253 and JP-A-61-97655. Coating processes described in *ibid.*, No. 17643, Item XV, pp. 28 to 29 may be employed.

The present invention maybe applied to various color light-sensitive materials. Typical examples of such color light-sensitive materials include color reversal films for slides or TV, instant color films and color reversal papers. It may also be applied to color hard copies for full color copiers or for preserving images on CRT. The present invention may further be applied to black-and-white light-sensitive materials utilizing the technique of mixing three color couplers described in, for example, *Research Disclosure*, No. 17123 (Jul., 1978).

In the case of using the light-sensitive material of the present invention as a material for color diffusion transfer process, dye developers may be used as color-forming materials. As the color materials themselves, those which are non-diffusible (immobile) in alkaline conditions (in a developer) but, as a result of development, release diffusible dyes (or their precursors) are advantageous. As the diffusible dye-releasing color-forming materials (DRR compounds), there are illustrated, for example, couplers and redox compounds capable of releasing a diffusible dye. These compounds are useful not only as color-forming materials for the color diffusion transfer process (wet process) but for heat-developable light-sensitive materials as well (dry process) describe din, for example, JP-A-58-58543.

The diffusible dye-releasing redox compounds (hereinafter referred to as "DRR compounds") are represented by the following general formula:

(Ballast)-(Redox-cleavable atom)-D

In the above formula, those compounds described in JP-A-58-163938, pp. 12 to 22 may be used as (Ballast) and (Redox-cleavable atom) groups. D represents a dye moiety (or its precursor). This dye moiety may be bonded to the redox-cleavable atom through a linking group. As the dye moiety represented by D, those described in the following publications are effective.

Examples of yellow dyes:

Those which are described in U.S. Pat. Nos. 3,597,200, 3,309,199, 4,013,633, 4,245,028, 4,156,609, 4,139,383, 4,195,992, 4,145,641, 4,148,643, 4,336,322, JP-A-51-114930, JP-A-56-71072, *Research Disclosure*, No. 17630 (Dec., 1978) and *ibid.*, No. 16475 (Dec., 1977).

Examples of magenta dyes:

Those which are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, JP-A-52-106727, JP-A-52-106727, JP-A-53-23628, JP-A-55-36804, JP-A-56-73057, JP-A-56-71060 and JP-A-55-134.

Examples of cyan dyes:

Those which are described in U.S. Pat. Nos. 3,482,972, 3,929,760, 4,013,635, 4,268,625, 4,171,220, 4,242,435, 4,142,891, 4,195,994, 4,147,544, 4,148,642, British Pat. No. 1,551,138, JP-A-54-99431, JP-A-52-8827, JP-A-53-47823, JP-A-53-143323, JP-A-54-99431, JP-A-56-71061, European Pat. Nos. 53,037 and 53,040, *Research Disclosure*, No. 17630 (Dec., 1978) and *ibid.*, No. 16475 (Dec., 1977).

These compounds are generally coated in amounts of about $1\times10^{-4}$ to $1\times10^{-2}$ mol/m$^2$, preferably $2\times10^{-4}$ to $2\times10^{2}$ mol/m$^2$.

In the present invention, the color material may be incorporated in a silver halide emulsion layer or in an adjacent layer on the exposed side, or the opposite side, of the emulsion layer.

In the case of using the light-sensitive material of the present invention as light-sensitive materials for a color diffusion transfer process, the photographic emulsions may be coated on the same support on which the image-receiving layer is coated, or on a different support. The silver halide photographic emulsion layer (light-sensitive element) and the image-receiving layer (image-receiving element) may be provided combined with each other as a film unit, or separated from each other. As the film unit, an integrated unit used throughout the steps of exposure, development, and viewing of transferred image, or a type capable of being peeled apart after development maybe used, with the latter type being more effective in the present invention.

The fogging processing to be employed in the direct positive color image-forming process of the present invention may be a fogging exposure, i.e., a photo-fogging process, or may be a chemically fogging process conducted in the presence of a nucleating agent. Light-sensitive materials containing a nucleating agent may be subjected to fogging exposure, but the chemically fogging process is preferred.

The nucleating agents to be used in the present invention may be incorporated in the light-sensitive material or in a processing solution, with the former being preferred.

In the case of incorporating nucleating agents in light-sensitive materials, they are preferably added to the internal latent image-forming silver halide emulsion layer but, as long as they can diffuse to silver halide grains to adsorb thereon during coating or processing, they may be added to other layers such as an interlayer, a subbing layer or a backing layer. In the case of adding the nucleating agent to a processing solution, it may be contained in a developer or in a pre-bath with a low pH as described in JP-A-58-178350.

In the case of incorporating the nucleating agent in the light-sensitive material, it is used in an amount of preferably $10^{-8}$ to $10^{-2}$ mol, more preferably $10^{-7}$ to $10^{-3}$ mol, per mol of silver halide.

In the case of adding the nucleating agent to a processing solution, it is used in an amount of preferably $10^{-8}$ to $10^{-3}$ mol, more preferably $10^{-7}$ to $10^{-4}$ mol, per liter.

As the nucleating agents to be used in the present invention, all conventional compounds for the purpose of nucleating internal latent image-forming silver halide may be employed. They may be used in combination of two or more. The nucleating agents are exemplified by those described in, for example, *Research Disclosure*, No. 22534 (Jan., 1976), pp. 50 to 54, *ibid.*, No. 15162 (Nov., 1976), pp. 76 to 77 and *ibid.*, No. 23510 (Nov., 1983), pp. 346 to 352, which are roughly categorized into three groups of quaternary heterocyclic compounds (preferably, those compounds represented by formula (N-I)), hydrazine compounds (preferably, those represented by formula (N-II)), and other compounds.

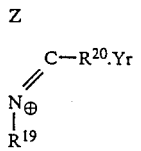

(N-I)

In the above formula Z represents a non-metallic atomic group necessary for forming a 5- to 6- membered hereto ring, and Z may be substituted by a substituent or substituents. $R^{19}$ represents an aliphatic group, and $R_{20}$ represents hydrogen, an aliphatic group or an aromatic group. $R^{19}$ and $R^{20}$ may be substituted by a substituent or substituents, provided that at least one of $R^{19}$, $R^{20}$, and Z contains an alkynyl group, an acyl group, a hydrazine group or a hydrazone group, or $R^{19}$ and $R^{20}$ are linked to form a dihydropyridinium ring. At least one substituent of $R^{19}$, $R^{20}$, and Z may contain:

$$X^1—(L^1)—S^1$$

(wherein $X^1$ represents a group accelerating adsorption to the surface of silver halide grains, $L^1$ represents a divalent linking group and $S^1$ represents 0 or 1), Y represents a counter ion for balancing charge, r is 0 or 1.

More specifically, the hetero ring formed by Z includes, for example, quinolinium, benzothiazolium, benzimidazolium, pyridinium, thiazolinium, thiazolium, naphthothiazolium, selenazolium, benzoselenazolium, imidazolium, tetrazolium, indolenium, pyrrolinium, acridinium, phenanthridinium, isoquinolinium, oxazolium, naphthoxzaolium and benzolium neclei. As substituents for Z, there are illustrated, for example, an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonate group, a hydrazine group, a hydrazone group or an imino group. When Z has two or more substituents they may be the same or different. The above-described substituents may further be substituted by the same substituents.

Further, substituents for Z may contain a heterocyclic quaternary ammonium group completed by Z, and linked to Z through a proper linking group L. In this case, the compounds have a dimer structure.

As preferred hetero rings completed by Z, there are illustrated quinolinium, benzothiazolium, benzimidazolium, pyridinium, acridinium, phenanthridinium and isoquinolinium nuclei, with quinolinium and benzothiazolium being more preferred, and quinolinium being most preferred.

The aliphatic group represented by $R^{19}$ or $R^{20}$ is an unsubstituted alkyl group containing 1 to 18 carbon atoms in the alkyl moiety. As the substituents, there are illustrated those as substituents for Z.

The aromatic group represented by $R^{20}$ is an aromatic group containing 6 to 20 carbon atoms, such as a phenyl group and a naphthyl group. As the substituents, there are illustrated those as substituents for Z. $R^{20}$ preferably represents an aliphatic group, most preferably a methyl group or a substituted methyl group.

At least one of the groups represented by $R^{19}$, $R^{20}$ and Z contains an alkyl group, an acyl group, a hydrazine group or a hydrazone group, or $R^{19}$ and $R^{20}$ are linked to each other to form a 6- membered ring, i.e., a dihydropyridinium ring. These substituents may further be substituted by those groups which ave been mentioned as substitutents for the group represented by Z.

Preferably, at least one substituent for the group or ring represented by $R^{19}$, $R^{20}$ and Z is an alkynyl group or an acyl group, or $R^{19}$ and $R^{20}$ are linked to each other to form a dihydropyridinium ring. More preferably, at least one alkynyl group is present.

As preferred examples of the group represented by $X^1$ capable of promoting adsorption to silver halide grains, there are illustrated a thioamido group, a mercapto group and a 5- to 6-membered nitrogen-containing heterocyclic group.

These groups may further be substituted by those substituents which have been mentioned as substituents for Z. Preferable examples of the thioamido group are noncyclic thioamido groups (e.g., thiourethane and thioureido).

As the mercapto group represented by $X^1$, heterocyclic mercapto groups (e.g., 5-mercaptotetrazole, 3-mercapto-1,2,4-triazole and 2-mercapto-1,3,4-thiadiazole) are particularly preferred.

The 5- to 6- membered nitrogen-containing heterocyclic group represented by $X^1$ contains a combination of nitrogen, oxygen, sulfur and carbon, and is preferably one which can produce imino silver, such as benzotriazole.

The divalent linking group represented by $L^1$ is an atom or atoms containing at least one of C, N, S, O; and specifically is one of a combination of, for example, an alkylene group, an alkenylene group, an alkynylene group, an arylene group, —O—, —S—, —NH—, —N—, —CO— and —$SO_2$— (these groups optionally have a substituent or substituents).

As the counter ion, Y, for balancing electric charge, there are illustrated a bromide ion, a chloride ion, an iodide ion, a p-toluenesulfonate ion, an ethylsulfonate ion, a perchlorate ion, a trifluoromethane-sulfonate ion and a thiocyanate ion.

These illustrated compounds and processes for their synthesis are described in, for example, patents cited in *Research Disclosure*, No. 22534 (Jan., 1983), pp. 50 to 54 and *ibid.*, No. 23213 (Aug., 1983), pp. 267 to 270, JP-B-49-38164, JP-B-52-19452, JP-B-52-47326, JP-A-52-69613, JP-A-52-3426, JP-A-55-138742 and JP-A-60-11837, and U.S. Pat. Nos. 4,306,016 and 4,471,944.

In the above formula, $R^{21}$ represents an aliphatic group, an aromatic group or a heterocyclic group; $R^{22}$ represents hydrogen, an alkyl group, an aralkyl group, an aryl group, an alkoxy group, an aryloxy group or an amino group; G represents a carbonyl group, a sulfonyl group, a sulfoxy group, a phosphoryl group or an iminomethylene group

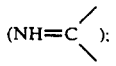

$R^{23}$ and $R^{24}$, which may be the same or different, each represents hydrogen, or one of them represents hydrogen and the other represents an alkylsulfonyl group, an arylsulfonyl group or an acyl group; provided that a hydrazone structure

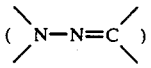

may be formed by G, $R^{23}$, $R^{24}$, and the hydrazine nitrogens, and that the above-mentioned groups may, if possible, be substituted by a substituent or substituents.

More specifically, $R^{21}$ may be substituted by a substituent or substituents. Examples of the substituents are an alkyl group, an aralkyl group, an alkoxy group, an alkyl or aryl group, a substituted amino group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxyl group, a halogen atom, a cyano group, a sulfo group and a carboxyl group, which may further be substituted. Of these, a ureido group is particularly preferably.

These groups may, if possible, be linked to each other to form a ring.

Preferred examples of $R^{21}$ include an aromatic group, an aromatic hereto ring or an aryl-substituted methyl group, with an aryl group (for example, phenyl or naphthyl) being more preferred.

Of the groups represented by $R^{22}$, a hydrogen atom, an alkyl group (e.g., methyl) and an aralkyl group (e.g., hydroxybenzyl) are preferred, with hydrogen being particularly preferred.

As the substituents for $R^{22}$, those illustrated for $R^{21}$ may be employed. In addition, other substituents such as an acyl group, an acyloxy group, an alkyl or aryloxycarbonyl group, an alkenyl group, an alkynyl group and a nitro group may also be employed.

These substituents may further be substituted by the same additional substituent groups. These may, if possible, be linked to each other to form a ring.

$R^{21}$ or $R^{22}$, particularly R21, may contain a diffusion-resistant group, i.e., a "ballast group" (preferably linked through a ureido group) and may contain the group $X^2$-$L^2$-$_{s^2}$, capable of promoting adsorption to the surface of silver halide grains. In formula, $X^2$ is the same as $X^1$ in formula (N-I) and is preferably a thioamido group (excluding thiosemicarbazido and its substituted derivatives), a mercapto group or a 5- to 6-membered nitrogen-containing heterocyclic group; $L_2$ represents a divalent linking group, and is the same as $L^1$ in formula (N-I); and $s^2$ represents 0 or 1.

$X^2$ more preferably represents an acyclic thioamido group (for example, thioureido or thiourethane), a cyclic thioamido group (i.e., mercapto-substituted, nitrogen-containing hereto ring group, such as 1-mercaptothiadiazolyl, 3-mercapto-1,2,4-triazoly, 5-mercaptotetrazolyl, 2-mercapto-1,3,4-oxadiazolyl, and 2-mercaptobenzoxazolyl) or a nitrogen-containing hetero ring group (for example, benzotriazolyl, benzimidazolyl or indazolyl).

The most preferred examples of $X^2$ vary depending upon the kind of light-sensitive material. For example, in the case of using, in color light-sensitive materials, color-forming materials ("couplers") capable of coupling with an oxidation product of a p-phenylenediamine type developing agent to form dyes, $X^2$ is preferably a mercapto-substituted nitrogen-containing hetero ring or a nitrogen-containing hetero ring capable of forming imino silver. In the case of using, in color light-sensitive materials, color-forming materials capable of cross-oxidizing an oxidation product of a color developer to produce a diffusible dye (so-called DRR compounds), $X^2$ is preferably an acyclic thioamido group or a mercapto-substituted, nitrogen-containing hetero ring.

As $R^{23}$ and $R^{24}$, a hydrogen atom is most preferred.

As G in formula (N-II), a carbonyl group is most preferred.

As compounds represented by formula (N-II) those which contain a group capable of adsorbing to the surface of silver halide grains or a ureido group are more preferred.

As to these illustrated compounds and processes for their synthesis, examples of the hydrazine type nucleating agents having the silver halide-adsorptive group are described in, for example, U.S. Pat. Nos. 4,030,925, 4,080,207, 4,031,127, 3,718,470, 4,269,929, 4,276,364, 4,278,748, 4,385,108, 4,459,347, 4,478,928 and 4,560,632, British Patent 2,011,391B, JP-A-54-74729, JP-A55-163533, JP-A-55-74536 and JP-A-60-179734.

Descriptions of other hydrazine type nucleating agents are given in, for example, JP-A-57-86829, U.S. Pat. Nos. 4,560,638, 4,478,928, 2,563,785 and 2,588,982.

$R_1$ to $R_{24}$ each contains 0 to 30 carbon atoms, and may be substituted by a substituent or substituents. Examples of the substituents are an alkyl group, an alkenyl group, an aralkyl group, an alkoxy group, an amino group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxyl group, a halogen, a cyano group, a sulfo group, a carboxyl group, an alkinyl group, an acyloxy group, and an alkoxycarbonyl group. Preferred examples of the substituents are an alkyl group, an aryl group, an alkoxy group, an acylamino group, a sulfonyl group, an amino group, a ureido group, a sulfamoyl group, a carbamoyl group, an alkylthio group, a hydroxyl group, a halogen, a cyano group, a sulfonyl group, and an alkoxycarbonyl group. More preferred examples of the substituent are an alkyl group, an alkoxy group, an acylamino group, a sulfonylamino group, a ureido group, an alkylthio group, a halogen, a cyano group, and an alkoxycarbonyl group.

$Z_1$ to $Z_3$ each represents an atomic group necessary for forming a substituted or unsubstituted 5- to 7-membered ring. Examples of the substituents are an alkyl group, an alkenyl group, an aralkyl group, an aryl group, an alkinyl group, a hydroxyl group, an alkoxy group, an aryloxy group, a halogen, an amino group, an alkylthio group, an arylthio group, an acyloxy group, an acylamino group, a sulfonyl group, a sulfonyloxy group, a sulfonylamino group, a carboxy group, an acyl group, a carbamoyl group, a sulfamoyl group, a sulfo group, a cyano group, a ureido group, a urethane group, a carbonate group, a hydrazinyl group, a hydrazonyl group, and an imino group.

V represents oxygen, sulfur or nitrogen. V may be substituted by a substituent, when it represents nitrogen. Examples of the substituents are an alkyl group, an aryl group, an aralkyl group, an alkenyl group, an alkinyl group, an amino group, a sulfonyl group, an acyl group, a carbamoyl group, a sulfamoyl group, and an alkoxycarbonyl group.

As nucleation promoters for promoting nucleation, tetrazaindenes, triazaindenes and pentazaindenes having at least one mercapto group optionally substituted by an alkali metal atom or an ammonium group, and those compounds which are described in JP-A-63-106656, pp. 12 to 43 may be added.

Specific examples of the nucleation promoter are illustrated below which, however, are not to be construed as limiting the scope of the present invention.

(A-1)

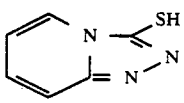

(A-2)

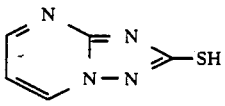

(A-3)

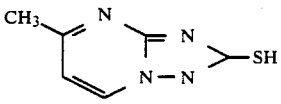

(A-4)

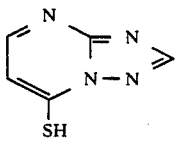

(A-5)

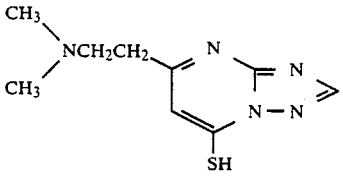

(A-6)

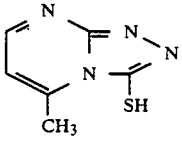

(A-7)

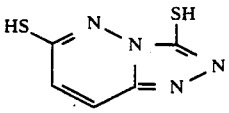

-continued (A-8)

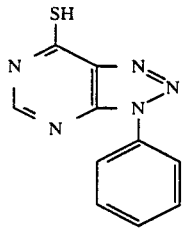

(A-9)

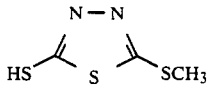

(A-10)

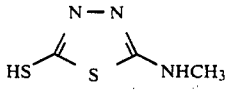

(A-11)

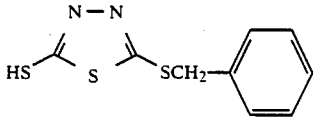

(A-12)

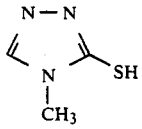

(A-13)

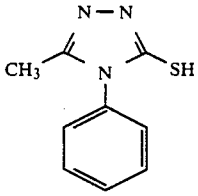

(A-14)

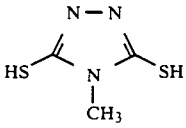

(A-15)

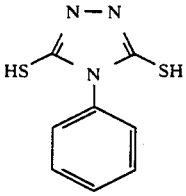

(A-16)

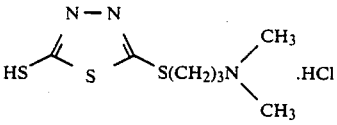

(A-17)

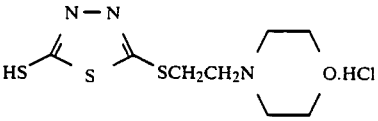

(A-18)

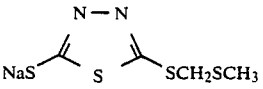

-continued (A-19)

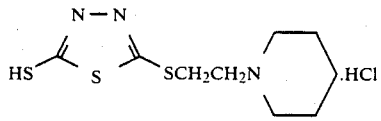

(A-20)

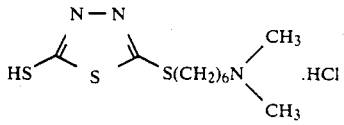

(A-21)

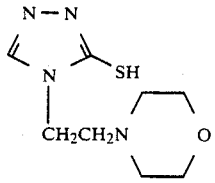

(A-21)

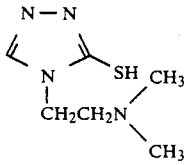

(A-23)

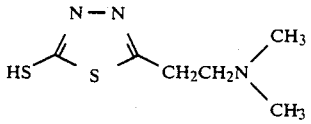

(A-24)

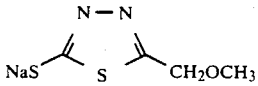

(A-25)

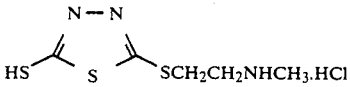

(A-26)

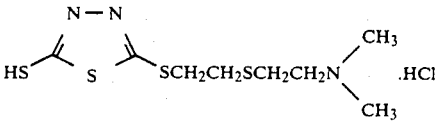

(A-27)

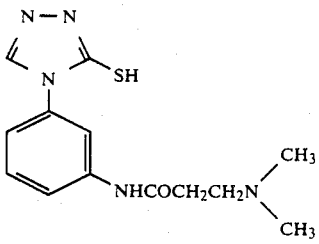

(A-28)

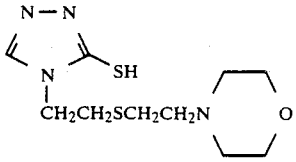

-continued (A-29)

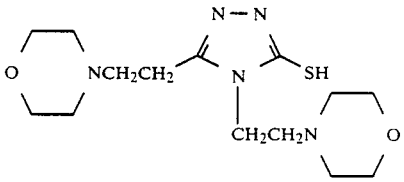

(A-30)

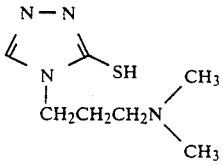

(A-31)

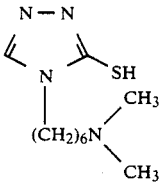

The nucleation promoters may be incorporated in a light-sensitive material or in a processing solution but are preferably in a light-sensitive material, particularly preferably in an internal latent image-forming silver halide emulsion layer or other hydrophilic colloid layer (for example, interlayer or protective layer) of the light-sensitive material. They are most preferably incorporated in a silver halide emulsion or in an adjacent layer thereto.

The nucleation promoters are added in amounts of preferably $10^{-7}$ to $10^{-2}$ mol, more preferably $10^{-5}$ to $10^{-2}$ mol, per mol of silver halide.

In the case of adding them to a processing solution, i.e., a developer or its pre-bath, they are added in amounts of preferably $10^{-8}$ to $10^{-3}$ mol, more preferably $10^{-7}$ to $10^{-4}$ mol, per liter.

Two or more nucleation promoters may be used in combination.

A color developer to be used for development-processing the light-sensitive material of the present invention is an alkaline aqueous solution containing substantially no silver halide solvent and preferably containing an aromatic primary amine color developing agent as a major component, and has a pH of up to 11.5 and preferably not less than 9.5, more preferably 11.2 to 9.8.

Preferably, the color developer to be used in the present invention contains substantially no benzyl alcohol. In preparing a low-replenishment type color development replenisher, incorporation of benzyl alcohol may require a long time for preparing solution or produce a tarry substance due to its low dissolution rate. A benzyl alcohol-free color developer has the advantage that, since it requires only a short time for preparing a solution and produces no tarry substance even with low-replenishment type, it is easy to prepare a low-replenishment type development replenisher. Further, in continuous processing using a benzyl alcohol-free color developer, a constant finish may be attained without formation of tarry substances and staining even when the replenishing amount is reduced to not more than half of the standard amount (i.e., not more than 165 ml/m$^2$), by preventing changes in the solution composition.

As additives to be used in the color developer of the present invention, various compounds described in JP-A-60-144739, pp. 14 to 22, JP-A-60-262161, pp. 45 to 50, JP-A-62-215272, pp. 11 to 22 may be used. In addition, the color developer of the present invention particularly preferably contains, as antifoggants, tetraazaindenes, benzindazoles, benzotriazoles, benzimidazoles, benzothiazoles, benzoxazoles, heterocyclic thiones such as 1phenyl-5-mercaptotetrazole, or aromatic or aliphatic mercapto compounds.

The color-developed photographic emulsion layers are usually bleached. Bleaching may be conducted separately or simultaneously with fixing. Further, in order to accelerate processing, a processing conducting bleach-fixing after bleaching or a processing conducting bleach-fixing after fixing may be employed. The bleaching solution or bleach-fixing solution of the present invention usually contains an iron aminopolycarboxylate complex salt as a bleaching agent. As additives to be used in the bleaching or bleach-fixing solution of the present invention, various compounds described in JP-A-62-215272, pp. 22 to 30 may be used.

Since leuco formation of cyan dye in the bleach-fixing solution is difficult when a benzyl alcohol-free color developer is used, the pH of the bleach-fixing solution or the amount of an oxidizing agent may be reduced.

The replenishing amount of the bleach-fixing solution is usually about 330 ml/m$^2$ and, when benzyl alcohol is not contained in the color developer, it may be reduced to not more than 60 ml/m$^2$.

The silver-removing step (bleach-fixing or fixing) is followed by processing such as washing with water and/or stabilizing processing. As additives to be used in the water-washing and stabilizing steps, various compounds described in JP-A-62-215272, pp. 30 to 36 may be used.

The amount of replenisher in each processing step is preferably minimized. The replenishing amount is preferably 0.1 to 50 times, more preferably 3 to 30 times, as much as the amount of pre-bath entrained by a unit area of light-sensitive material to be processed.

As supports to be used in the present invention, any of transparent supports such as polyethylene terephthalate and cellulose triacetate and reflective supports may be used. As the reflective supports, baryta paper, polyethylene-coated paper, polypropylene synthetic paper, transparent supports (for example, a glass plate, polyester film (e.g., polyethylene terephthalate, cellulose triacetate or cellulose nitrate), polyamide film, polycarbonate film or polystyrene film) having a reflective layer or using a reflective body in combination, or supports composed of a transparent or opaque base having provided thereon, for example, a mirror surface film layer or metal powder-filled layer to give a mirror surface reflection or second diffused reflection properties as described in JP-A-61-210346 and JP-A-63-24247, may be used. These may properly be selected for use depending upon the end-use of the light-sensitive materials.

In the case of using the DRR compounds in the present invention, any silver halide developing agent (or electron donor) that can cross-oxidize them may be used.

Such developer may be incorporated in an alkaline development processing solution (processing element) or in a proper layer of a photographic element. Developing agents to be used in the present invention are exemplified by: hydroquinone, aminophenol (e.g., N-methylaminophenol), 1-phenyl-3-pyrazolidinone, 1-phenyl-4,4-dimethyl-3-pyrazolidinone, 1-phenyl-4-methyl-4-hydroxymethyl-3-pyrazolidinone, N,N-diethyl-p-phenylenediamine, 3-methyl-N,N-diethyl-p-phenylenediamine, and 3-methoxy-N-ethoxy-p-phenylenediamine.

Of these, black-and-white developing agents which generally can reduce stain of the image-receiving layer (mordant layer) are particularly preferably as is the same with the aforesaid alkaline development processing solution.

In the case of using the light-sensitive material of the present invention as a material for a diffusion transfer process film unit, it is preferred to use a viscous developer for its processing. This viscous developer is a liquid composition containing processing ingredients necessary for development of a silver halide emulsion (and formation of a diffusion transfer dye image). A major component of the composition is water, with a hydrophilic solvent such as methanol or methyl-cellosolve being optionally contained. Preferably, the processing composition contains a high molecular hydrophilic polymer such as polyvinyl alcohol, hydroxyethyl cellulose or a sodium salt of carboxy-methylcellulose. These polymers are used to give the resulting processing composition a viscosity of 1 poise or more, preferably about 500 to about 1,000 poises, at room temperature.

The above-described processing composition is preferably contained in a rupturable pod as described in, for example, U.S. Pat. Nos. 2,543,181, 2,643,886, 2,653,732, 2,723,051, 3,056,491, 3,056,492, and 3,152,515.

The present invention is now illustrated in greater detail by reference to the following examples which, however, are not to be construed as limiting the present invention in any way. Unless otherwise indicated, all parts, percents and ratios are by weight.

EXAMPLE 1

Emulsion A was prepared as follows.

Emulsion A

An aqueous solution of potassium bromide and an aqueous solution of silver nitrate were simultaneously added to a gelatin aqueous solution containing 0.27 g of 3,4-dimethyl-1,3-thiazoline-2-thione per mol of silver with vigorous stirring at 75° C. in about 7 minutes to obtain an octahedral monodisperse silver bromide emulsion of 0.3 μm in average grain size. To this emulsion were added 47 mg of sodium thiosulfate and 47 mg of chloroauric acid (4 hydrate) per mol of silver to conduct chemical ripening. The thus obtained silver bromide grains were used as cores and were further processed for 40 minutes under the same precipitation circumstance as in the first procedure to thereby further grow the grains till an octahedral monodisperse core/shell silver bromide emulsion of 0.65 μm (variation coefficient: 11%) in average grain size was obtained.

After removal of silver, 3.1 mg of sodium thiosulfate and 3.1 mg of chloroauric acid (4 hydrate) were added to the emulsion per mol of silver to conduct chemical sensitization to obtain a core/shell type internal latent image-forming silver halide emulsion A.

A color photographic printing paper of the layer structure shown in Table 1 provided on polyethylene-double laminated paper support was prepared using emulsion A. The coating solutions were prepared as follows.

Preparation of coating solution for 1st layer:

10 ml of ethyl acetate and 4 ml of solvent (c) were added to 10 g of cyan coupler (a) and 2.3 g of color image stabilizer (b) to prepare a solution. This solution was then emulsified and dispersed in 90 ml of a 10 % gelatin aqueous solution containing 5 ml of a 10% sodium dodecylbenzenesulfonate solution. Separately $2.0\times10^{-4}$ mol of the following red-sensitive dye was added to the silver halide emulsion A (containing 70 g of Ag/kg) per mol of silver halide, to prepare 90 g of a red-sensitive emulsion. The emulsion dispersion, the emulsion, and development promoter (d) were mixed to prepare a solution, and the concentrations were adjusted to those given in Table 1. Further, $4\times10^{-5}$ mol of a nucleating agent and $5\times10^{-4}$ mol of a nucleation promoter described below were added thereto per mol of Ag to prepare a coating solution for the 1st layer.

Coating solutions for the 2nd to 7th layers were also prepared in the same manner as with the coating solution for the 1st layer. 1-Hydrozy-3,5-dichloro-s-triazine sodium salt was used as a gelatin hardener for each layer.

TABLE 1

| Layer | Main Formulation | Used Amount |
|---|---|---|
| 12th layer (protective layer) | Gelatin | 1.33 g/m$^2$ |
| | Latex particles of polymethyl methacrylate (average particle size: 2.8μ) | 0.05 g/m$^2$ |
| | Acryl-modified copolyer of polyvinyl alcohol (modification degree: 17%) | 0.17 g/m$^2$ |
| 11th layer (UV absorbing layer) | Gelatin | 0.54 g/m$^2$ |
| | Color mixing-preventing agent (e) | $3\times10^{-4}$ mol/m2 |
| | UV absorbent (i) | $5.10\times10^{-4}$ mol/m$^2$ |
| | Solvent (k) | 0.08 g/m$^2$ |
| 10th layer (blue-sensitive layer) | Emulsion (as silver amount) | 0.40 g/m$^2$ |
| | Gelatin | 1.35 g/m$^2$ |
| | Yellow coupler (l) | $6.91\times10^{-4}$ mol/m$^2$ |
| | Color image stabilizer (m) | 0.13 g/m$^2$ |
| | Solvent (h) | 0.02 g/m$^2$ |
| | Development promoter (d) | 32 g/m$^2$ |
| | Nucleating agent and nucleation promoter | |
| 9th layer | Gelatin | 0.60 g/m$^2$ |
| 8th layer (UV absorbing layer) | Gelatin | 1.60 g/m$^2$ |
| | Colloidal silver (as silver) | 0.10 g/m$^2$ |
| | UV absorbent (i) | $1.70\times10^{-4}$ mol/m$^2$ |
| | Color mixing-preventing agent (j) | $1.60\times10^{-4}$ mol/m$^2$ |
| | Solvent (k) | 0.24 g/m$^2$ |
| 7th layer | Gelatin | 0.60 g/m$^2$ |
| | Color mixing-preventing agent (e) | $3\times10^{-4}$ mol/m$^2$ |
| 6th layer | Gelatin | 0.60 g/m$^2$ |
| 5th layer (green-sensitive layer | Emulsion (as silver amount) | 0.20 g/m$^2$ |
| | Gelatin | 1.56 g/m$^2$ |
| | Magenta coupler (f) | $3.38\times10^{-4}$ mol/m$^2$ |
| | Color image stabilizer (g) | 0.19 g/m$^2$ |
| | Solvent (h) | 0.59 g/m$^2$ |
| | Development promoter (d) | 32 g/m$^2$ |
| | Nucleating agent and nucleation promoter | |
| 4th layer | Gelatin | 0.90 g/m$^2$ |

TABLE 1-continued

| Layer | Main Formulation | Used Amount |
|---|---|---|
| (color mixing-preventing layer) | Colloidal silver (as silver) | 0.02 g/m$^2$ |
| | Color mixing-preventing agent (e) | $2.33\times10^{-4}$ mol/m$^2$ |
| 3rd layer (red-sensitive layer) | Emulsion (as silver amount) | 0.40 g/m$^2$ |
| | Gelatin | 0.90 g/m$^2$ |
| | Cyan coupler (a) | $7.05\times10^{-4}$ mol/m$^2$ |
| | Color image stabilizer (b) | $5.20\times10^{-4}$ mol/m$^2$ |
| | Solvent (c) | 0.22 g/m$^2$ |
| | Development promoter (d) | 32 g/m$^2$ |
| | Nucleating agent and nucleation promoter | |
| 2nd layer | Gelatin | 0.90 g/m$^2$ |
| | Color mixing-preventing agent (e) | $1\times10^{-4}$ mol/m2 |
| 1st layer | Gelatin | 0.90 g/m$^2$ |
| | Color mixing-preventing agent (e) | $3\times10^{-4}$ mol/m2 |
| Support | Polyethylene-laminated paper (containing a white pigment (e.g., $TiO_2$) and a bluing dye (e.g., ultramarine) in polyethylene of the first layer side) | |
| Curl-preventing layer | Gelatin | 2.70 g/m$^2$ |

As a spectrally sensitizing agent for the core emulsion, the following compounds were used.

4-Hydroxy-6-methyl-1,3,3a,7-tetrazaindene was added in an amount of 4 mg/m$^2$ in each emulsion layer.

Red-sensitive dye:

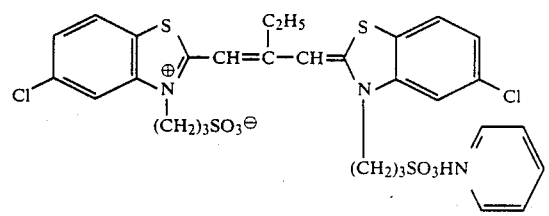

Green-sensitive dye:

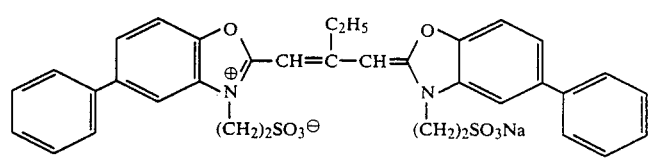

Blue-sensitive dye:

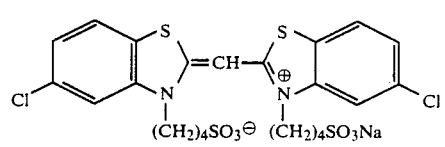

The following dyes were used as irradiation-preventing dyes.

Irradiation-preventing dye for green-sensitive emulsion layer:

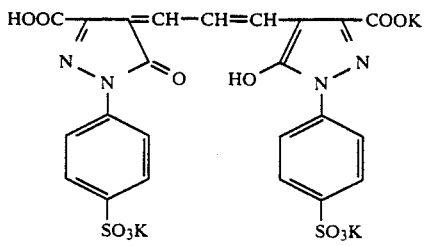
Irradiation-preventing dye for red-sensitive emulsion layer:
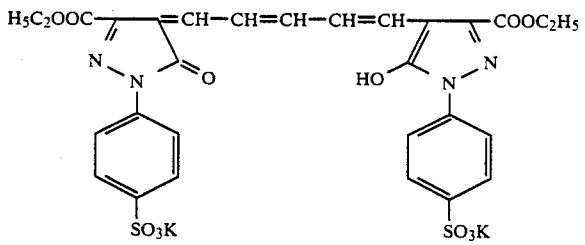
The structural formulae of the compounds used in this Example are as follows:
(a) Cyan coupler:
A 1:1 mixture (molar ratio) of
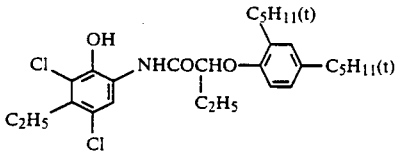
and
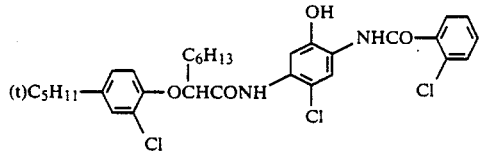
(b) Color image stabilizer:
A 1:3:3 mixture (molar ratio) of
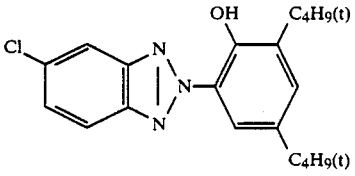
-continued
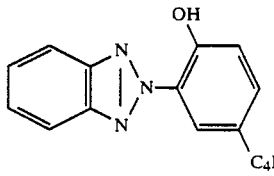
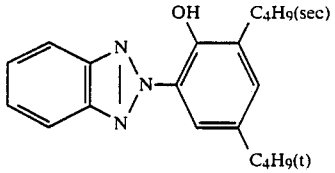
(c) Solvent:
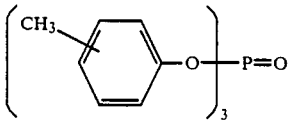
(d) Development promoter
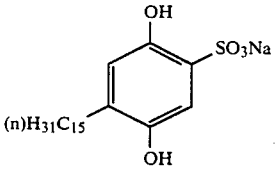
(e) Color mixing-preventing agent
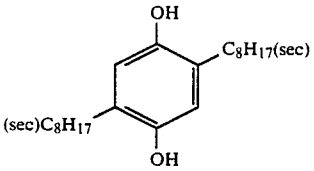
(f) Magenta coupler

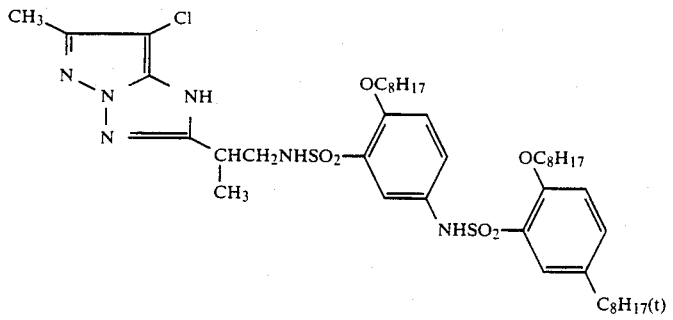
(g) Color image stabilizer
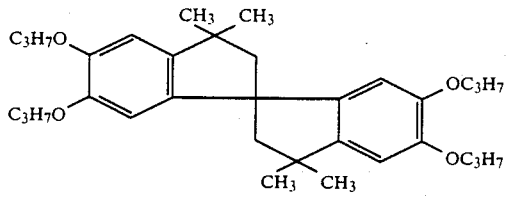
(h) Solvent
A 2:1 mixture (by weight) of
$(^{(n)}C_8H_{17}O)_3P{=}O$
and
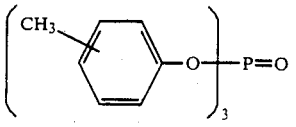
(i) UV absorbent
A 1:5:3 mixture (molar ratio) of
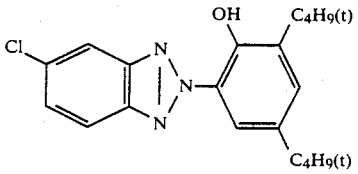
-continued
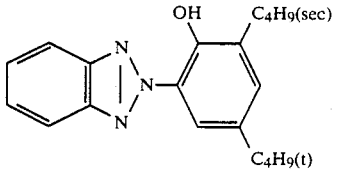
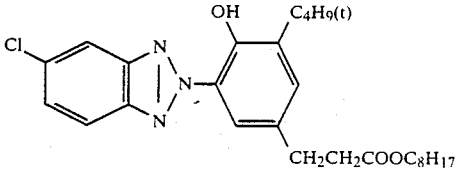
(j) Color mixing-preventing agent
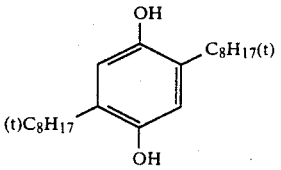
(k) Solvent
$(isoC_9H_{19}O)_3{-}P{=}O$
(l) Yellow coupler
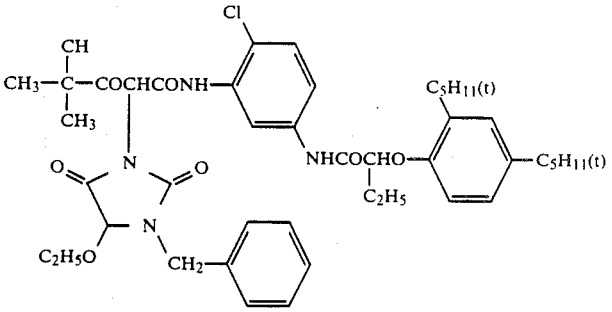
(m) Color image stabilizer

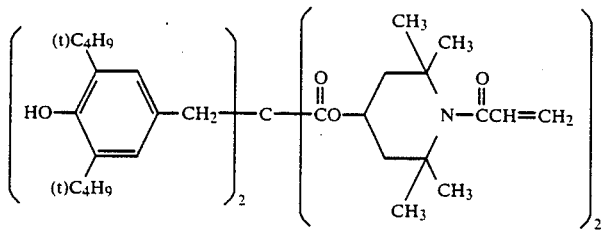

Nucleating agent

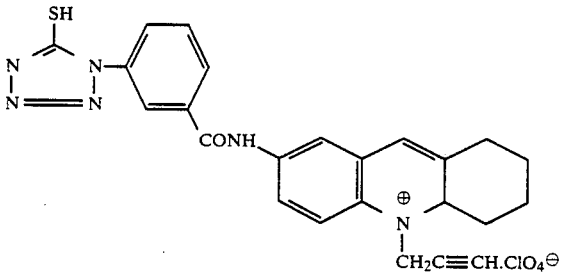

Nucleation promoter

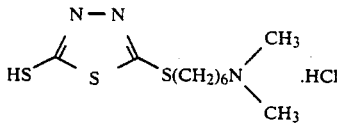

After adjusting balance of surface tension and viscosity, the coating solutions for the 1st to 7th layers were simultaneously coated to obtain a light-sensitive material, sample 101.

Emulsion B

An aqueous solution of potassium bromide and an aqueous solution of silver nitrate were simultaneously added to a gelatin aqueous solution containing 0.27 g of 3,4-dimethyl-1,3-thiazoline-2-thione per mol of silver with vigorous stirring at 75° C in about 7 minutes to obtain a tetradecahedral monodisperse emulsion (variation coefficient: 9%) of 0.6 μm in average grain size. After removal of silver, the emulsion was chemically sensitized with sodium thiosulfate and chloroauric acid (4 hydrate) to obtain negative-working silver bromide emulsion B.

Preparation of Sample 102:

Sample 102 was prepared in the same manner as sample 101 except for adding emulsion B (coated silver amount: 0.03 g/m2) and a green-sensitive dye to the 1st layer of sample 101.

Preparation of Sample1 103:

Sample 103 was prepared in the same manner as sample 101 except for adding emulsion B (coated silver amount: 0.03 g/m$^2$) and a red-sensitive dye to the 7th layer of sample 101.

Preparation of Sample 104:

Sample 104 was prepared in the same manner as sample 101 except for adding emulsion B (coated silver amount: 0.03 g/m$^2$) and a red-sensitive dye to the 11th layer of sample 101.

Preparation of Sample 105:

Sample 105 was prepared in the same manner as sample 102 except for adding emulsion B (coated silver amount: 0.03 g/m$^2$) and a red-sensitive dye to the 7th layer of sample 102.

Preparation of Sample 106 to 108:

Sample 106 to 108 were prepared in the same manner as sample 102 except for adding each of the compounds shown in Table 2 in an amount of $3\times10^{-6}$ mol/m$^2$ to the 1st layer of sample 102.

Preparation of Sample 109 to 113:

Sample 109 to 113 were prepared in the same manner as sample 103 except for adding each of the compounds shown in Table 2 in an amount of $1\times10^{-6}$ mol/m$^2$ to the 7th layer of sample 103.

Preparation of Sample 114:

Sample 104 was prepared in the same manner as sample 104 except for adding the compounds shown in Table 2 in an amount of $3\times10^{-6}$ mol/m$^2$ to the 11th layer of sample 104.

Preparation of Sample 115:

Sample 105 was prepared in the same manner as sample 105 except for adding the compounds shown in Table 2 in an amount of $3\times10^{-6}$ mol/m$^2$ and $1\times10^{-6}$ mol/m$^2$, respectively, to the 1st and the 7th layers of sample 105.

(3) Exposure and development processing:

Four samples were prepared for each of samples 101 to 115, and were exposed to red light, green light, blue light, and white light (red + green + blue), respectively. The exposure amounts of red light, green light, and blue light upon white light exposure were the same as those employed for the independent red light exposure, green light exposure, and blue light exposure.

The thus-exposed samples were development processed according to the following processing steps.

| Processing step | Time | Temp. |
|---|---|---|
| Color development | 3'30" | 33° C. |
| Bleach-fixing | 1'30" | 33° C. |
| Stabilizing (1) | 1' | 33° C. |
| Stabilizing (2) | 1' | 33° C. |
| Stabilizing (2) | 1' | 33° C. |

Replenishing of the stabilizing bath was conducted in a countercurrent replenishing manner, wherein stabilizing bath (3) was first replenished with a replenisher, an overflow solution from the stabilizing bath (3) was introduced into the stabilizing bath (2), and an overflow solution from the stabilizing bath (2) was introduced into the stabilizing bath (1).

| Color developer | |
|---|---|
| Diethylenetriaminepentaacetic acid | 2.0 g |
| Benzyl alcohol | 12.8 g |
| Diethylene glycol | 3.4 g |
| Sodium sulfate | 2.0 g |
| Sodium bromide | 0.26 g |

-continued

| Color developer | |
|---|---|
| Hydroxylamine sulfate | 2.60 g |
| Sodium chloride | 3.20 g |
| 3-Methyl-4-amino-N-ethyl-N-(β-methanesulfonamidoethyl)aniline sulfate | 4.25 g |
| Potassium carbonate | 30.0 g |
| Brightening agent (stilbene type) | 1.0 g |
| Water to make | 1000 ml |
| pH | 10.0 to 10.4 |

pH was adjusted with potassium hydroxide or hydrochloric acid.

| Bleach-fixing solution | |
|---|---|
| Ammonium thiosulfate | 110 g |
| Sodium hydrogensulfite | 10 g |
| Iron (III) ammonium diethylenetriamine pentaacetate monohydrate | 56 g |
| Disodium ethylenediaminetetraacetate dihydrate | 5 g |
| 2-Mercapto-1,3,4-triazole | 0.5 g |
| Water to make | 1000 ml |

pH was adjusted with aqueous ammonia or hydrochloric acid.

| Stabilizing solution | |
|---|---|
| 1-Hydroxyethylidene-1,1'-diphosphonic acid (60%) | 1.6 ml |
| Bismuth chloride | 0.35 g |
| Polyvinylpyrrolidone | 0.25 g |
| Aqueous ammonia | 2.5 g |
| Trisodium nitrilotriacetate | 1.0 g |
| 5-Chloro-2-methyl-4-isothiazolin-3-one | 50 mg |
| 2-Octyl-4-isothiazolin-3-one | 50 mg |
| Brightening agent (4,4'-diaminostilbene type) | 1.0 g |
| Water to make | 1000 ml |

-continued

| Stabilizing solution | |
|---|---|
| pH | 7.5 |

pH was adjusted with potassium hydroxide or hydrochloric acid.

(4) Evaluation

The cyan density for red light exposure was compared with that for white light exposure to measure the exposure difference, Δlog E (R), in a portion of 1.0 in density. Likewise, magenta density for green light exposure was compared with that for white light exposure, and yellow density for blue light exposure with that for white light exposure to measure exposure differences, Δlog E (G) and Δlog E (B), in a portion of 1.0 in density. A higher log E value means a better interlayer effect.

The results thus obtained are shown in Table 2.

TABLE 2

| Sample No. | Negative-working emulsion-containing layer | Compound added to negative-working emulsion layer | Δlog E (R) | Δlog E (G) | Δlog E (B) |
|---|---|---|---|---|---|
| 101 (comparative sample) | — | — | 0.07 | 0.10 | 0.05 |
| 102 (comparative sample) | 1st layer | — | 0.07 | 0.10 | 0.05 |
| 103 (comparative sample) | 7th layer | — | 0.06 | 0.09 | 0.06 |
| 104 (comparative sample) | 11th layer | — | 0.08 | 0.09 | 0.05 |
| 105 (comparative sample) | 1st and 7th layers | — | 0.06 | 0.10 | 0.05 |
| 106 (present invention) | 1st layer | 1-25 | 0.25 | 0.14 | 0.06 |
| 107 (present invention) | " | 2-9 | 0.23 | 0.15 | 0.07 |
| 108 (present invention) | " | 3-13 | 0.27 | 0.14 | 0.07 |
| 109 (present invention) | 7th layer | 1-15 | 0.12 | 0.29 | 0.12 |
| 110 (present invention) | " | 1-5 | 0.15 | 0.27 | 0.12 |
| 111 (present invention) | " | 2-18 | 0.12 | 0.26 | 0.11 |
| 112 (present invention) | " | 3-11 | 0.15 | 0.31 | 0.13 |
| 113 (present invention) | " | 3-12 | 0.12 | 0.32 | 0.15 |
| 114 (present invention) | 11th layer | 1-29 | 0.12 | 0.17 | 0.20 |
| 115 (present invention) | 1st and 7th layers | 3-10 | 0.27 | 0.32 | 0.15 |

As is shown in Table 2, the direct positive color light-sensitive material of the present invention exhibited an improved interlayer effect in comparison with the comparative samples.

The use of the direct positive color light-sensitive material of the present invention improved the interlayer effect without delaying color development processing.

While the present invention has been described in detail and with reference to specific embodiments thereof, it is apparent to one skilled in the art that various changes and modifications can be made therein without departing from the spirit and the scope of the present invention.

What is claimed is:

1. A direct positive color light-sensitive material, which comprises a support having thereon at least one internal latent image-forming silver halide emulsion layer containing non-prefogged silver halide grains and which contains at least one color image-forming coupler capable of producing or releasing a non-diffusible or diffusible dye upon oxidative coupling with a color-developing agent, with at least one layer different from said internal latent image-forming silver halide emulsion layer containing a surface latent image-forming, negative-working silver halide emulsion and with at least one of said negative-working silver halide emulsion layer and an interlayer adjacent thereto containing at least one compound capable of releasing a fogging agent, a fogging agent precursor, a development promoter or a development promoter precursor in proportion to the amount of developed silver of said negative-working silver halide emulsion upon development processing using an aromatic primary amine developing agent.

2. The direct positive color light-sensitive material as claimed in claim 1, wherein said internal latent image-forming silver halide emulsion layer and said negative-working silver halide emulsion layer are spectrally sensitized to substantially different spectral regions.

3. The direct positive color light-sensitive material as claimed in claim 2, further comprising a second internal latent image-forming silver halide emulsion layer spectrally sensitized to substantially the same spectral region as said surface latent image-forming, negative-working silver halide emulsion.

4. The direct positive color light-sensitive material as claimed in claim 1, further comprising a light-insensitive layer comprising a hydrophilic polymer from 0.05 to 5 μm thick between said negative-working silver halide emulsion layer and said internal latent image-forming silver halide emulsion layer.

5. The direct positive color light-sensitive material as claimed in claim 1, wherein said negative-working silver halide emulsion layer is between said support and said internal latent image-forming silver halide emulsion layer nearest to said support.

6. The direct positive color light-sensitive material as claimed in claim 1, wherein said internal latent image-forming silver halide emulsion layer furthest from said support is between said support and said negative-working silver halide emulsion layer.

7. The direct positive color light-sensitive material as claimed in claim 1, wherein said compound capable of releasing said fogging agent, said fogging agent precursor, said development promoter or said development promoter precursor is represented by formulae (1), (2), or (3):

$$C_p\text{—(TIME)}_n\text{—FA} \quad (1)$$

$$\text{BALL—}C_p\text{—(TIME)}_n\text{—FA} \quad (2)$$

$$\text{RED—(TIME)}_n\text{—FA} \quad (3)$$

wherein $C_p$ represents a coupler residue capable of coupling with an oxidation product of an aromatic primary amine developing agent to release —(TIME)$_n$—FA in formula (1) and to release BALL in formula (2); BALL represents a diffusion-resistant group capable of being eliminated from $C_p$ by a coupling reaction with an oxidation product of an aromatic primary amine developing agent; RED represents a compound residue capable of undergoing an oxidation-reduction reaction with an oxidation product of an aromatic primary amine developing agent to release (TIME)$_n$—FA; represents a timing group capable of releasing —FA after being released from $C_p$ or RED; FA represents a fogging agent, a fogging agent precursor, a development promoter or a development promoter precursor; and n is 0 or 1.

8. The direct positive color light-sensitive material as claimed in claim 7, wherein FA is represented by formula (4):

$$\text{AD—(L)}_m\text{—X} \quad (4)$$

wherein AD represents a group capable of adsorbing to silver halide grains; L represents a divalent linking group; m is 0 or 1; and X represents a reductive group or a group capable of acting on silver halide to produce silver sulfide.

9. The direct positive color light-sensitive material as claimed in claim 7, wherein $C_p$ is a yellow coupler residue represented by formulae (Ia) or (IIa):

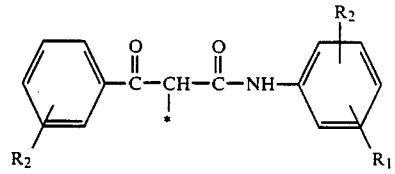
(Ia)

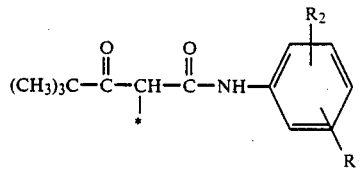
(IIa)

wherein * indicates the coupling position; $R_1$ represents a diffusion-resistant group containing a total of 8 to 32 carbon atoms; and $R_2$ represents at least one hydrogen, halogen, lower alkyl group, lower alkoxy group or diffusion-resistant group containing a total of 8 to 32 carbon atoms, provided that plural $R_2$ groups may be the same or different.

10. The direct positive color light-sensitive material as claimed in claim 7, wherein $C_p$ is a magneta coupler residue represented by formulae (IIIa), (IVa) or (Va):

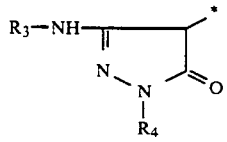
(IIIa)

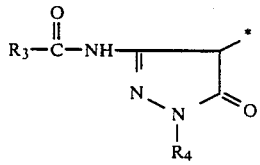
(IVa)

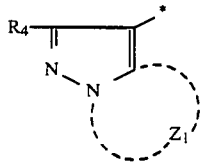
(Va)

wherein * indicates the coupling position; $R_3$ represents a diffusion-resistant group containing a total of 8 to 32 carbon atoms; and $R_4$ represents at least one halogen, lower alkyl group, lower alkoxy group, unsubstituted phenyl group or substituted phenyl group; and $Z_1$ represents a non-metallic group necessary for forming a substituted or unsubstituted 5-membered azole ring containing 2 to 4 nitrogen atoms or a condensed ring thereof.

11. The direct positive color light-sensitive material as claimed in claim 7, wherein $C_p$ is a cyan coupler residue represented by formulae (VIa), (VIIa), (VIIIa) or (IXa):

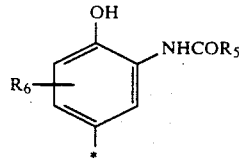
(VIa)

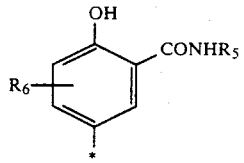
(VIIa)

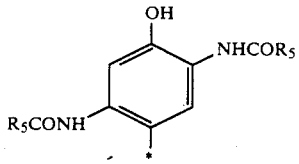
(VIIIa)

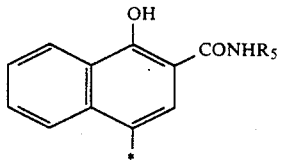
(IXa)

wherein * indicates the coupling position; $R_5$ represents a diffusion-resistant group containing a total of 8 to 32 carbon atoms; and $R_6$ represents at least one halogen, lower alkyl group, or lower alkoxy group, provided that plural $R_6$ groups may be the same or different.

12. The direct positive color light-sensitive material as claimed in claim 7, wherein $C_p$ is a colorless compound forming coupler residue represented by formulae (Xa), (XIa), or (XIIa):

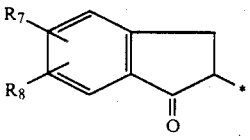
(Xa)

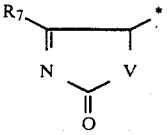
(XIa)

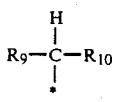
(XIIa)

wherein * indicates the coupling position; $R_7$ represents a diffusion-resistant group containing a total of 8 to 32 carbon atoms; and $R_8$ represents hydrogen, a halogen, a lower alkyl group or a lower alkoxy group; V represents oxygen, sulfur or nitrogen; $R_9$ and $R_{10}$, which may be the same or different, each represents an alkoxycarbonyl group, an aminocarbonyl group, an acyl group, or a sulfonic acid or sulfinic acid derivative of an alkoxy-carbonyl group, an aminocarbonyl group or an acyl group; a cyano group; an ammoniumyl group; or a nitrogen-containing hetero ring linked to C via a nitrogen thereof; provided that $R_9$ and $R_{10}$ may be linked to form a 5-membered or 6-membered ring.

13. The direct positive color light-sensitive material as claimed in claim 7, wherein $C_p$ is a black color coupler residue represented by formulae (XIIIa), (XIVa) and (XVa):

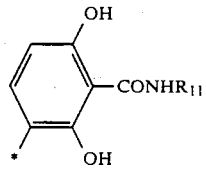
(XIIIa)

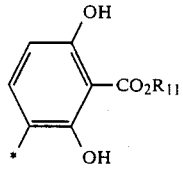
(XIVa)

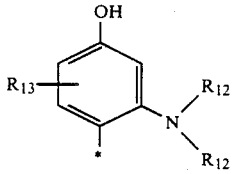
(XVa)

wherein * indicates the coupling position; $R_{11}$ represents an alkyl group containing 3 to 20 carbon atoms, an unsubstituted phenyl group or a phenyl group substituted with at least one hydroxyl group, halogen, amino group, alkyl group containing 1 to 20 carbon atoms, or alkoxy group; $R_{12}$ represents hydrogen, a halogen, an alkyl group containing 1 to 20 carbon atoms, an alkenyl group containing 1 to 20 carbon atoms, or an aryl group containing 6 to 20 carbon atoms, and plural $R_{12}$ groups may be the same or different; $R_{13}$ represents a halogen, an alkyl group containing 1 to 20 carbon atoms, an alkoxy group containing 1 to 20 carbon atoms, or a monovalent organic group, and plural $R_{13}$ groups may be the same or different.

14. The direct positive color light-sensitive material as claimed in claim 7, wherein RED is represented by formulae (XVIa), (XVIIa), (XVIIIa), (XIXa), (XXa) or (XXIa):

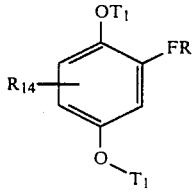
(XVIa)

-continued (XVIa)

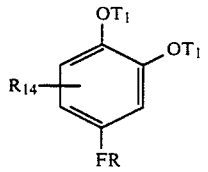

(XVIIIa)

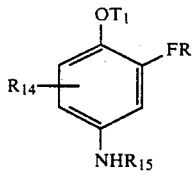

(XIXa)

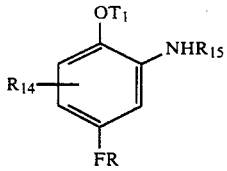

(XXa)

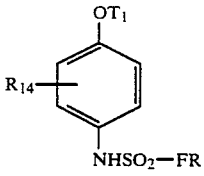

(XXIa)

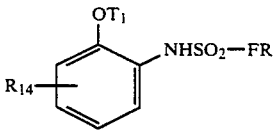

wherein FR represents —(TIME)$_n$—FA, wherein TIME, n and FA each has the same significance as that in claim 7, $R_{14}$ represents at least one hydrogen, halogen, alkyl group, aryl group, alkoxy group, aryloxy group, alkylthio group, arylthio group, cyano group, alkoxycarbonyl group, carbamoyl group, sulfamoyl group, carboxyl group, sulfo group, sulfonyl group, acyl group, carbonamide group, sulfonamide group or heterocyclic group, an plural $R_{14}$ groups may be the same or different, provided that two $R_{14}$ groups in vic-positions may be linked to form a benzene ring or a 5-membered to 7-membered hetero ring; $R_{15}$ represents an alkyl group, an aryl group, an acyl group, a carbamoyl group, a sulfonyl group or a sulfamoyl group; $T_1$ represents hydrogen or a group capable of being cleaved by hydrolysis under alkaline conditions, and plural $T_1$ groups may be the same or different.

15. The direct positive color light-sensitive material as claimed in claim 7, wherein FA is represented by formulae (XXIIa) or (XXIIIa):

(XXIIa)

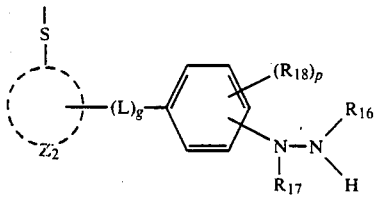

-continued (XXIIIa)

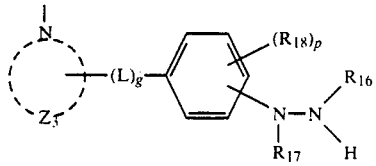

wherein $R_{16}$ represents an acyl group, a carbamoyl group an alkylsulfonyl group, an arylsulfonyl group, an alkoxycarbonyl group, an aryloxycarbonyl group or a sulfamoyl group; $R_{17}$ represents hydrogen, an acyl group, an alkoxycarbonyl group, an alkylsulfonyl group, an arylsulfonyl group or an aryloxycarbonyl group; $R_{18}$ represents a halogen, an alkoxy group, an alkyl group, an alkenyl group, an aryl group, an aryloxy group, an alkylthio group, an arylthio group, a carbonamido group or a sulfonamido group; p is 0 or an integer of 1 to 4, and plural $R_{18}$ groups may be the same or different and may be linked to form a ring; L is a divalent linking group; q is 0 or 1; $Z_2$ represents an atomic group necessary for forming a monocyclic or condensed hetero ring; and $Z_3$ represents an atomic group necessary for forming a monocyclic or condensed hetero ring together with

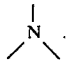

16. The direct positive color light-sensitive material as claimed in claim 8, wherein AD is selected from a nitrogen-containing hetero ring having a dissociatable hydrogen; a hetero ring containing at least one nitrogen atom and at at least one other hetero atom selected from oxygen, sulfur and selenium, a hetero ring substituted with a mercapto group; a quaternary salt; a thiophenol; an alkylthiol, and a compound having the structure

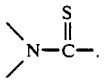

17. The direct positive color light-sensitive erial as claimed in claim 8, wherein L is selected from alkylene, alkenylene, phenylene, naphthylene, oxygen, sulfur, —SO—, —$SO_2$—, —N=N—, carbonyl, amido, thioamido, sulfonamido, ureido, thioureido and a hetero ring.

18. The direct positive color light-sensitive material as claimed in claim 1, wherein said compound capable of releasing a fogging agent, a fogging agent precursor, a development promoter or a development promoter precursor is present in an amount of $10^9$ to $10^{-1}$ mol per mol of silver halide contained in a layer containing said compound or its adjacent layer.

19. The direct positive color light-sensitive material as claimed in claim 18, wherein said compound capable of imagewise releasing a fogging agent, a fogging agent precursor, a development promoter or a development promoter precursor is present in an amount of $10^{-8}$ to $10^{-2}$ mol per mol of silver halide contained in a layer containing said compound or its adjacent layer.

* * * * *

UNITED STATES PATENT AND TRADEMARK OFFICE

CERTIFICATE OF CORRECTION

PATENT NO. : 4,994,358

DATED : February 19, 1991

INVENTOR(S) : Naoyasu Deguchi, et al

It is certified that error appears in the above-indentified patent and that said Letters Patent is hereby corrected as shown below:

Column 2, line 49, delete "b". Column 5, line 21, delete "$TIME_n$" and insert -- $(TIME)_n$ --; line 29, delete "$TIME_n$ (" and insert -- $(TIME)_n$- --; line 39, delete "$C_{or}$", insert -- $C_p$ or --. Column 6, line 2, delete "positiOn", insert --position--. Column 7, line 54, delete "7928", insert --187928--. Column 8, line 63, delete both occurrences of "9group", and insert --group-- (both occurrences). Column 9, line 59, delete "diffusiOn", insert --diffusion--. Column 10, lines 5, 6 and 7, delete "$-O-\overset{\overset{\displaystyle O}{\|}}{C}-$ "; line 9, after "-N=N-,", insert -- $-O-\overset{\overset{\displaystyle O}{\|}}{C}-$ --.

Column 14, lines 48 to 52, delete

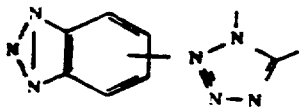

and insert --

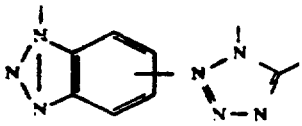

--.

UNITED STATES PATENT AND TRADEMARK OFFICE

CERTIFICATE OF CORRECTION

PATENT NO. : 4,994,358

DATED : February 19, 1991

INVENTOR(S) : Naoyasu Deguchi et al

It is certified that error appears in the above-indentified patent and that said Letters Patent is hereby corrected as shown below:

Column 49, line 29, delete "10-2" and insert --$10^{-2}$--; line 32, delete "10-4" and insert -- $10^{-4}$ --; line 33, delete "10-3" and insert --$10^{-3}$--. Column 54, line 21, delete "$10^{2}$" and insert --$10^{-2}$--.

Please add columns 55 and 56 as follows:

-- $10^{-8}$ to $10^{-3}$ mol, more preferably $10^{-7}$ to $10^{-4}$ mol, per liter.

As the nucleating agents to be used in the present invention, all conventional compounds for the purpose of nucleating internal latent image-forming silver halide may be employed. They may be used in combination of two or more. The nucleating agents are exemplified by those described in, for example, Research Disclosure, No. 22534 (Jan., 1976), pp. 50 to 54, ibid., No. 15162 (Nov., 1976), pp. 76 to 77 and ibid.,

--

It is certified that error appears in the above-indentified patent and that said Letters Patent is hereby corrected as shown below:

No. 23510 (Nov., 1983), pp. 346 to 352, which are roughly categorized into three groups of quaternary heterocyclic compounds (preferably, those compounds represented by formula (N-I)), hydrazine compounds (preferably, those represented by formula (N-II)), and other compounds.

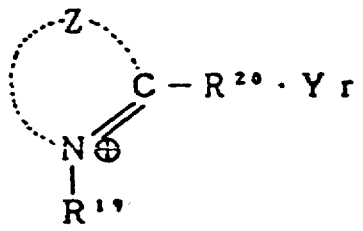

(N-I)

In the above formula Z represents a non-metallic atomic group necessary for forming a 5- to 6-membered hetero ring, and Z may be substituted by a substituent or substituents. $R^{19}$ represents an aliphatic group, It is certified that error appears in the above-indentified patent and that said Letters Patent is hereby corrected as shown below:

and $R^{20}$ represents hydrogen, an aliphatic group or an aromatic group. $R^{19}$ and $R^{20}$ may be substituted by a substituent or substituents, provided that at least one of $R^{19}$, $R^{20}$, and Z contains an alkynyl group, an acyl group, a hydrazine group or a hydrazone group, or $R^{19}$ and $R^{20}$ are linked to form a dihydropyridinium ring. At least one substituent of $R^{19}$, $R^{20}$, and Z may contain:

$$X^1\text{—}(L^1)_{s1}$$

(wherein $X^1$ represents a group accelerating adsorption to the surface of silver halide grains, $L^1$ represents a divalent linking group and $s^1$ represents 0 or 1), Y represents a counter ion for balancing charge, r is 0 or 1.

More specifically, the hetero ring formed by Z includes, for example, quinolinium, benzothiazolium, benzimidazolium, pyridinium, thiazolinium, thiazolium, It is certified that error appears in the above-indentified patent and that said Letters Patent is hereby corrected as shown below:

naphthothiazolium, selenazolium, benzoselenazolium, imidazolium, tetrazolium, indolenium, pyrrolinium, acridinium, phenanthridinium, isoquinolinium, oxazolium, naphthoxazolium and benzolium nuclei. As substituents for Z, there are illustrated, for example, an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonate group, a hydrazine group, a hydrazone group or an imino group. When Z has two or more substituents they may be the same or different.

It is certified that error appears in the above-indentified patent and that said Letters Patent is hereby corrected as shown below:

The above-described substituents may further be substituted by the same substituents.

Further, substituents for Z may contain a heterocyclic quaternary ammonium group completed by Z, and linked to Z through a proper linking group L. In this case, the compounds have a dimer structure.

As preferred hetero rings completed by Z, there are illustrated quinolinium, benzothiazolium, benzimidazolium, pyridinium, acridinium, phenanthridinium and isoquinolinium nuclei, with quinolinium and benzothiazolium being more preferred, and quinolinium being most preferred.

The aliphatic group represented by $R^{19}$ or $R^{20}$ is an unsubstituted alkyl group containing 1 to 18 carbon atoms in the alkyl moiety. As the substituents, there are illustrated those as substituents for Z.

It is certified that error appears in the above-indentified patent and that said Letters Patent is hereby corrected as shown below:

The aromatic group represented by $R^{20}$ is an aromatic group containing 6 to 20 carbon atoms, such as a phenyl group and a naphthyl group. As the substituents, there are illustrated those as substituents for Z. $R^{20}$ preferably represents an aliphatic group, most preferably a methyl group or a substituted methyl group.

At least one of the groups represented by $R^{19}$, $R^{20}$ and Z contains an alkyl group, an acyl group, a hydrazine group or a hydrazone group, or $R^{19}$ and $R^{20}$ are linked to each other to form a 6-membered ring, i.e., a dihydropyridinium ring. These substituents may further be substituted by those groups which have been mentioned as substituents for the group represented by Z.

Preferably, at least one substituent for the group or ring represented by $R^{19}$, $R^{20}$ and Z is an alkynyl group or an acyl group, or $R^{19}$ and $R^{20}$ are linked to each It is certified that error appears in the above-indentified patent and that said Letters Patent is hereby corrected as shown below:

other to form a dihydropyridinium ring. More preferably, at least one alkynyl group is present.

As preferred examples of the group represented by $X^1$ capable of promoting adsorption to silver halide grains, there are illustrated a thioamido group, a mercapto group and a 5- to 6-membered nitrogen-containing heterocyclic group.

These groups may further be substituted by those substituents which have been mentioned as substituents for Z. Preferable examples of the thioamido group are non-cyclic thioamido groups (e.g., thiourethane and thioureido).

As the mercapto group represented by $X^1$, heterocyclic mercapto groups (e.g., 5-mercaptotetrazole, 3-mercapto-1,2,4-triazole and 2-mercapto-1,3,4,-thiadizaole) are particularly preferred.

--

It is certified that error appears in the above-indentified patent and that said Letters Patent is hereby corrected as shown below:

The 5- to 6-membered nitrogen-containing heterocyclic group represented by $X^1$ contains a combination of nitrogen, oxygen, sulfur and carbon, and is preferably one which can produce imino silver, such as benzotriazole.

The divalent linking group represented by $L^1$ is an atom or atoms containing at least one of C, N, S, O; and specifically is one or a combination of, for example, an alkylene group, an alkenylene group, an alkynylene group, an arylene group, -O-, -S-, -NH-, -N=, -CO- and $-SO_2-$ (these groups optionally have a substituent or substituents).

As the counter ion, Y, for balancing electric charge, there are illustrated a bromide ion, a chloride ion, an iodide ion, a p-toluenesulfonate ion, an ethylsulfonate ion, a perchlorate ion, a trifluoromethanesulfonate ion

CERTIFICATE OF CORRECTION

PATENT NO. : 4,994,358
DATED : February 19, 1991
INVENTOR(S) : Naoyasu Deguchi et al It is certified that error appears in the above-indentified patent and that said Letters Patent is hereby corrected as shown below:

and a thiocyanate ion.

These illustrated compounds and processes for their synthesis are described in, for example, patents cited in Research Disclosure, No. 22534 (Jan., 1983), pp. 50 to 54 and ibid., No. 23213 (Aug., 1983), pp. 267 to 270, JP-B-49-38164, JP-B-52,19452, JP-B-52-47326, JP-A-52-69613, JP-A-52-3426, JP-A-55-138742 and JP-A-60-11837, and U.S. Patents 4,306,016 and 4,471,044.

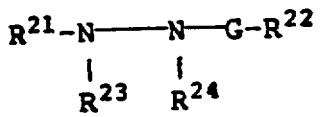

(N-II)

--.

Column 57, line 11, delete "NH" and insert --HN--; line 60, delete "R21" and insert --$R^{21}$--. Column 71, line 56, delete the "Sample1" and insert --Sample--. Column 72, line 26, delete "Sample 104" and insert --

UNITED STATES PATENT AND TRADEMARK OFFICE

CERTIFICATE OF CORRECTION

PATENT NO. : 4,994,358

DATED : February 19, 1991

INVENTOR(S) : Naoyasu Deguchi et al

It is certified that error appears in the above-indentified patent and that said Letters Patent is hereby corrected as shown below:

Sample 114--; line 32, delete "Sample 105" and insert --Sample 115--. Column 80, line 48, delete "erial" and insert --material--.

Signed and Sealed this

Eleventh Day of April, 1995

Bruce Lehman

*Attest:*

BRUCE LEHMAN

*Attesting Officer*

*Commissioner of Patents and Trademarks*